US010024147B2

(12) United States Patent
Hamid et al.

(10) Patent No.: US 10,024,147 B2
(45) **Date of Patent: *Jul. 17, 2018**

(54) DOWNHOLE PRESSURE MAINTENANCE SYSTEM USING REFERENCE PRESSURE

(71) Applicant: Halliburton Energy Services, Inc., Houston, TX (US)

(72) Inventors: Syed Hamid, Dallas, TX (US); Tyson Harvey Eiman, Frisco, TX (US); Gregory William Garrison, Dallas, TX (US); Colby Munro Ross, Carrollton, TX (US); William Mark Richards, Flower Mound, TX (US); Thomas Jules Frosell, Irving, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 239 days.

This patent is subject to a terminal disclaimer.

(21) Appl. No.: 14/916,328

(22) PCT Filed: Jan. 13, 2015

(86) PCT No.: PCT/US2015/011225
§ 371 (c)(1),
(2) Date: Mar. 3, 2016

(87) PCT Pub. No.: WO2016/114765
PCT Pub. Date: Jul. 21, 2016

(65) Prior Publication Data

US 2016/0356133 A1 Dec. 8, 2016

(51) Int. Cl.
*E21B 34/08* (2006.01)
*E21B 43/12* (2006.01)
(Continued)

(52) U.S. Cl.
CPC ..... *E21B 43/12* (2013.01); *E21B 21/001* (2013.01); *E21B 21/08* (2013.01); *E21B 33/12* (2013.01);
(Continued)

(58) Field of Classification Search
CPC ..... E21B 34/10; E21B 34/06; E21B 34/08; E21B 34/066
See application file for complete search history.

(56) References Cited

U.S. PATENT DOCUMENTS 3,308,882 A * 3/1967 Lebourg ..... E21B 49/081 166/138
4,535,843 A * 8/1985 Jageler ..... E21B 33/1243 166/187
(Continued)

FOREIGN PATENT DOCUMENTS

JP 2002-180781 A 6/2002

OTHER PUBLICATIONS

International Search Report and Written Opinion issued by the Korean Intellectual Property Office regarding International application No. PCT/US2015/011225 dated Oct. 13, 2015, 14 pages.

*Primary Examiner* — Kipp C Wallace
(74) *Attorney, Agent, or Firm* — Haynes and Boone, LLP

(57) ABSTRACT

A method and apparatus that includes an elongated base pipe having an external surface at least partially defining an external region and an internal surface at least partially defining an internal region; and a pressure maintenance device disposed in the base pipe and includes a first flow path that extends between an opening in the external surface and an opening in the internal surface; a first valve that controls the flow of a first fluid through the first flow path; a first pressure differential sensor that controls the actuation of the first valve and is in fluid communication with the external region; and a pressurized fluid source in fluid
(Continued)

communication with the first pressure differential sensor; wherein a first pressure differential threshold associated with the first pressure differential sensor is the difference between a pressure within the external region and the pressurized fluid source.

20 Claims, 12 Drawing Sheets

(51) Int. Cl.

| | |
|---|---|
| ***E21B 43/04*** | (2006.01) |
| ***E21B 43/14*** | (2006.01) |
| ***E21B 21/00*** | (2006.01) |
| ***E21B 21/08*** | (2006.01) |
| ***E21B 33/12*** | (2006.01) |
| ***E21B 34/06*** | (2006.01) |
| ***E21B 34/10*** | (2006.01) |
| ***E21B 47/00*** | (2012.01) |
| ***E21B 47/06*** | (2012.01) |

(52) U.S. Cl.
CPC ..... *E21B 34/063* (2013.01); *E21B 34/08* (2013.01); *E21B 34/10* (2013.01); *E21B 43/04* (2013.01); *E21B 43/14* (2013.01); *E21B 47/0001* (2013.01); *E21B 47/06* (2013.01)

(56) References Cited

U.S. PATENT DOCUMENTS

| | | | | |
|---|---|---|---|---|
| 4,621,655 | A * | 11/1986 | Roche | E21B 21/001 137/81.2 |
| 6,148,915 | A | 11/2000 | Mullen et al. | |
| 6,298,767 | B1 * | 10/2001 | Porter | E21B 33/0355 166/344 |
| 7,487,837 | B2 | 2/2009 | Bailey et al. | |
| 7,938,189 | B2 * | 5/2011 | Rytlewski | E21B 34/14 166/317 |
| 8,353,351 | B2 * | 1/2013 | Carpenter | E21B 21/08 166/311 |
| 2002/0189815 | A1 * | 12/2002 | Johnson | E21B 34/08 166/373 |
| 2009/0025947 | A1 | 1/2009 | Peltonen | |
| 2010/0018714 | A1 * | 1/2010 | Merlau | E21B 23/04 166/319 |
| 2013/0008647 | A1 * | 1/2013 | Dirksen | E21B 21/103 166/250.01 |
| 2013/0180711 | A1 | 7/2013 | Barrilleaux | |
| 2014/0160891 | A1 | 6/2014 | Russell | |
| 2015/0176376 | A1 * | 6/2015 | Gisolf | E21B 43/12 166/250.01 |
| 2015/0308203 | A1 * | 10/2015 | Lewis | E21B 47/06 175/48 |
| 2016/0319635 | A1 * | 11/2016 | Du | E21B 43/12 |
| 2017/0122069 | A1 * | 5/2017 | Rytlewski | E21B 34/10 |

* cited by examiner

DOWNHOLE PRESSURE MAINTENANCE SYSTEM USING REFERENCE PRESSURE

TECHNICAL FIELD

The present disclosure relates generally to a downhole pressure maintenance system, and specifically a pressure maintenance system that maintains a pressure within an isolated annulus of a wellbore within a predetermined pressure range.

BACKGROUND

After a well is drilled and a target reservoir has been encountered, completion and production operations are performed, which may include gravel packing operations. Generally, gravel packing operations include placing a lower completion assembly, which forms part of a working string, downhole within a target reservoir in a formation. In a multi-zone completion, a number of packers are located within the lower completion assembly and are activated to isolate a portion of a wellbore annulus formed between the working string and the casing (if a cased hole) or the formation (if an open hole). Each of these portions may be production zones that are subsequently packed with gravel or coarse sand. Often, after one of the packers is set but prior to the gravel packing of the production zones, each production zone is isolated from the wellbore hydrostatic pressure. As the formation absorbs drilling fluids from each production zone, the wellbore annulus pressure within each of the production zones may drop, which may cause collapse of an open hole or influx of sand in an unconsolidated cased hole installation.

The present disclosure is directed to a downhole pressure maintenance system that overcomes one or more of the shortcomings in the prior art.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
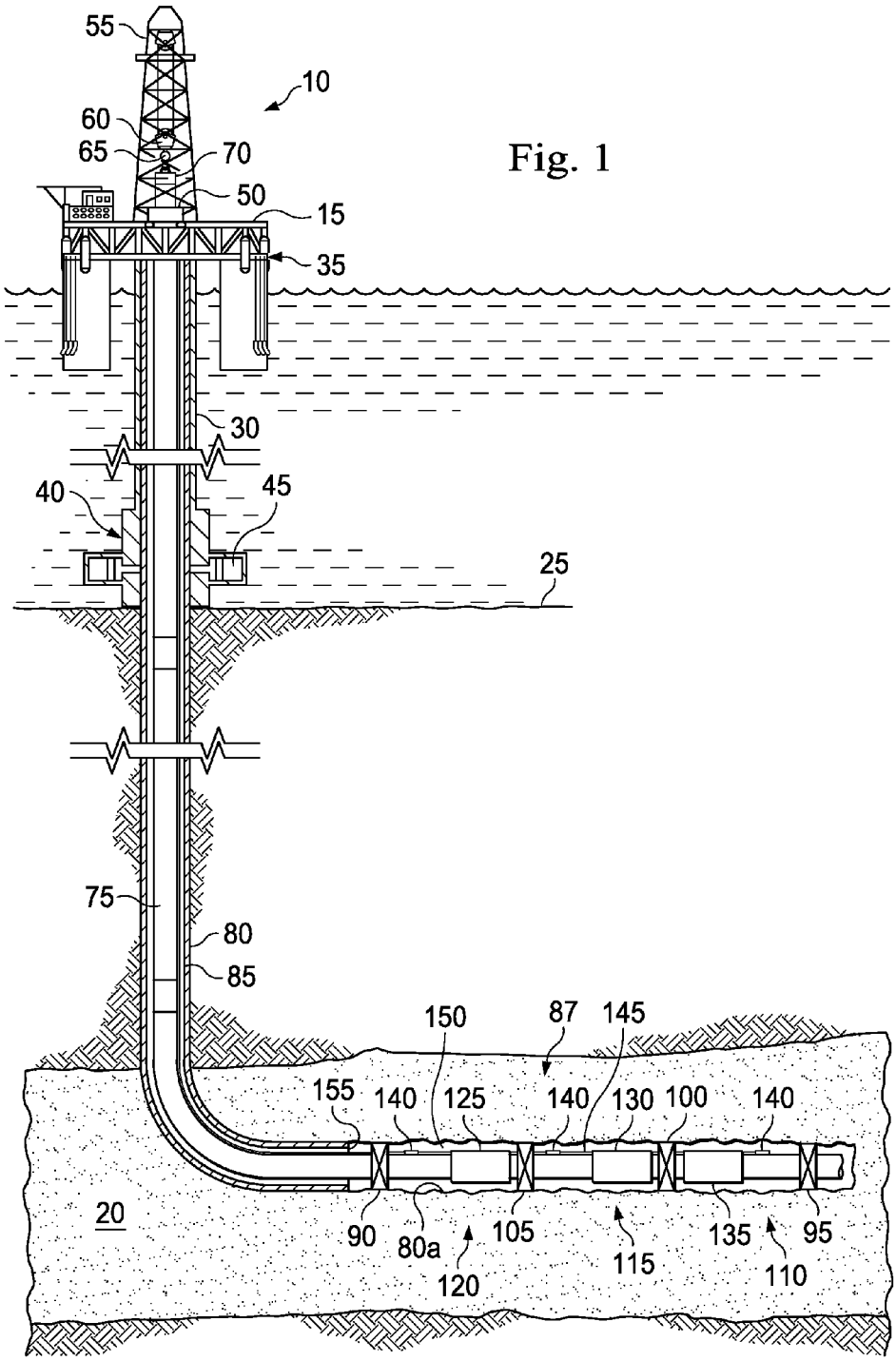
FIG. 1 is a schematic illustration of an oil and gas rig operably coupled to a lower completion system, the lower completion system including a pressure maintenance device, according to an exemplary embodiment of the present disclosure.

Illustrative embodiments and related methods of the present disclosure are described below as they might be employed in a downhole pressure maintenance system. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would iii nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, an offshore oil or gas platform is schematically illustrated and generally designated 10. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 60, a hook 65, and a swivel 70 for raising and lowering pipe strings, such as a substantially tubular, axially extending working string 75.

A wellbore 80 extends through the various earth strata including the formation 20 and has a casing string 85 cemented therein. Disposed in a substantially horizontal portion of the wellbore 80 is a lower completion assembly 87 that forms a part of the working string 75 and that may include an isolation packer 90 and a sump packer 95. The lower completion assembly 87 may also include packers 100 and 105 that at least partially define a first zone 110, a second zone 115, and a third zone 120 of the lower completion assembly 87. In one or more exemplary embodiments, a portion of the formation 20 that surrounds the first zone 110, the second zone 115, and the third zone 120 may be associated with a reservoir pressure. In one or more exemplary embodiments, the first zone 110, the second zone 115, and the third zone 120 are associated with production zones. In one or more exemplary embodiments, each of a flow regulating systems 125, 130, and 135 is located on the lower completion assembly 87 within each of the third zone 120, the second zone 115, and the first zone 110, respectively. In one or more exemplary embodiments, a pressure maintenance device ("PMD") 140 is located on or in the lower completion assembly 87 within each of the first zone 110, the second zone 115, and the third zone 120. One or more communication cables, such as an electric cable 145, may pass through the packers 90, 100, and 105 and may be provided and extend from the lower completion assembly 87 to the surface in an wellbore annulus 150 formed between the working string 75 and the casing 85 or an interior surface 80*a* of the wellbore 80 when the wellbore 80 is an open hole wellbore.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Also, even though FIG. 1 depicts an offshore operation, it should be understood by those skilled in the art that the apparatus according to the present disclosure is equally well suited for use in onshore operations. Further, even though FIG. 1 depicts an open hole completion, it should be understood by those skilled in the art that the apparatus according to the present disclosure is equally well suited for use in cased hole completion.

Figure 2:
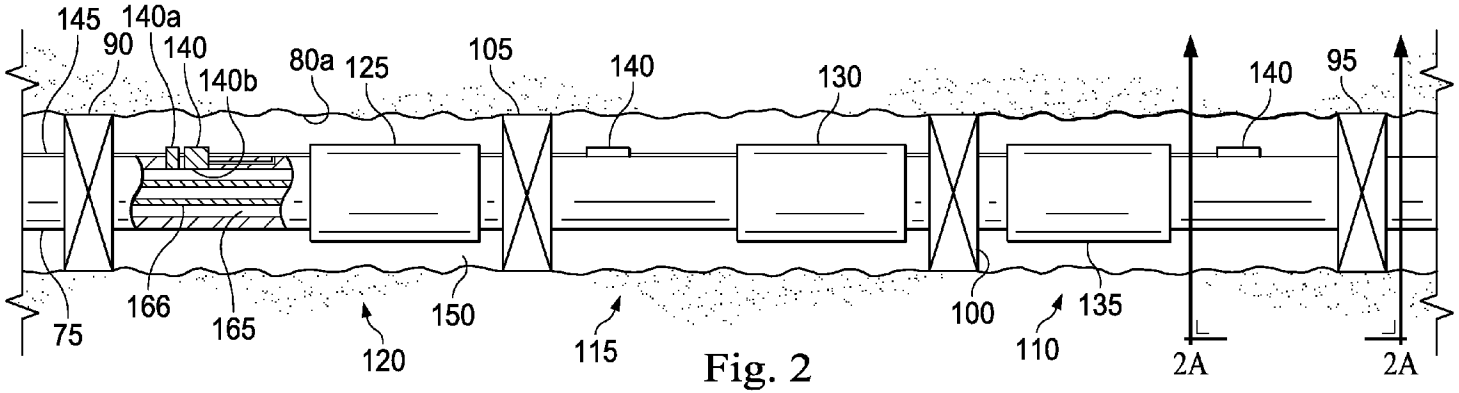
FIG. 2 is a schematic illustration of the lower completion system of FIG. 1, according to an exemplary embodiment of the present disclosure.

In one or more exemplary embodiments and illustrated in FIG. 2, the PMD 140 has an exterior surface 140*a* and an interior surface 140*b*. In an exemplary embodiment, the interior surface 140*b* at least partially defines an internal region or a completion string annulus 165. In one or more exemplary embodiments, the exterior surface 140*a* at least partially defines an external region or the wellbore annulus 150. The PMD 140 may be located within the lower completion assembly 87 to fluidically connect the wellbore annulus 150 and the completion string annulus 165 that is formed between the inner surface of the lower completion assembly 87 and an exterior surface of a tubing string 166 that extends within the lower completion assembly 87.

Figure 2A:
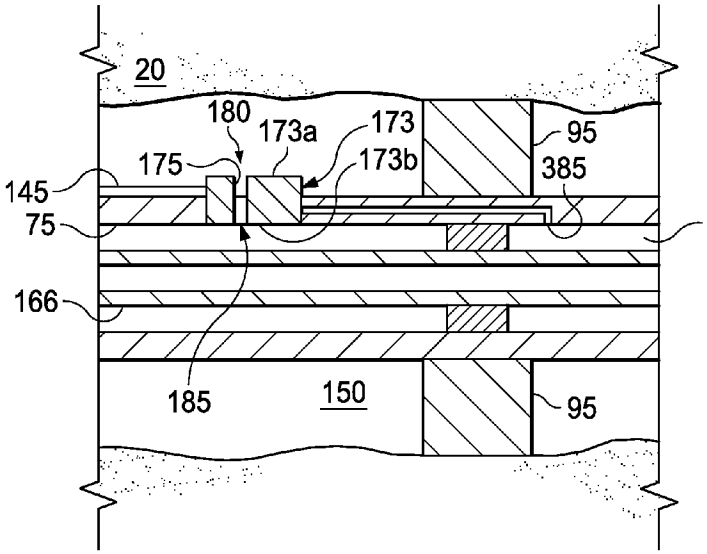
FIG. 2A is an enlarged view of a portion of the lower completion system of FIG. 2, according to an exemplary embodiment of the present disclosure.
Figure 3:
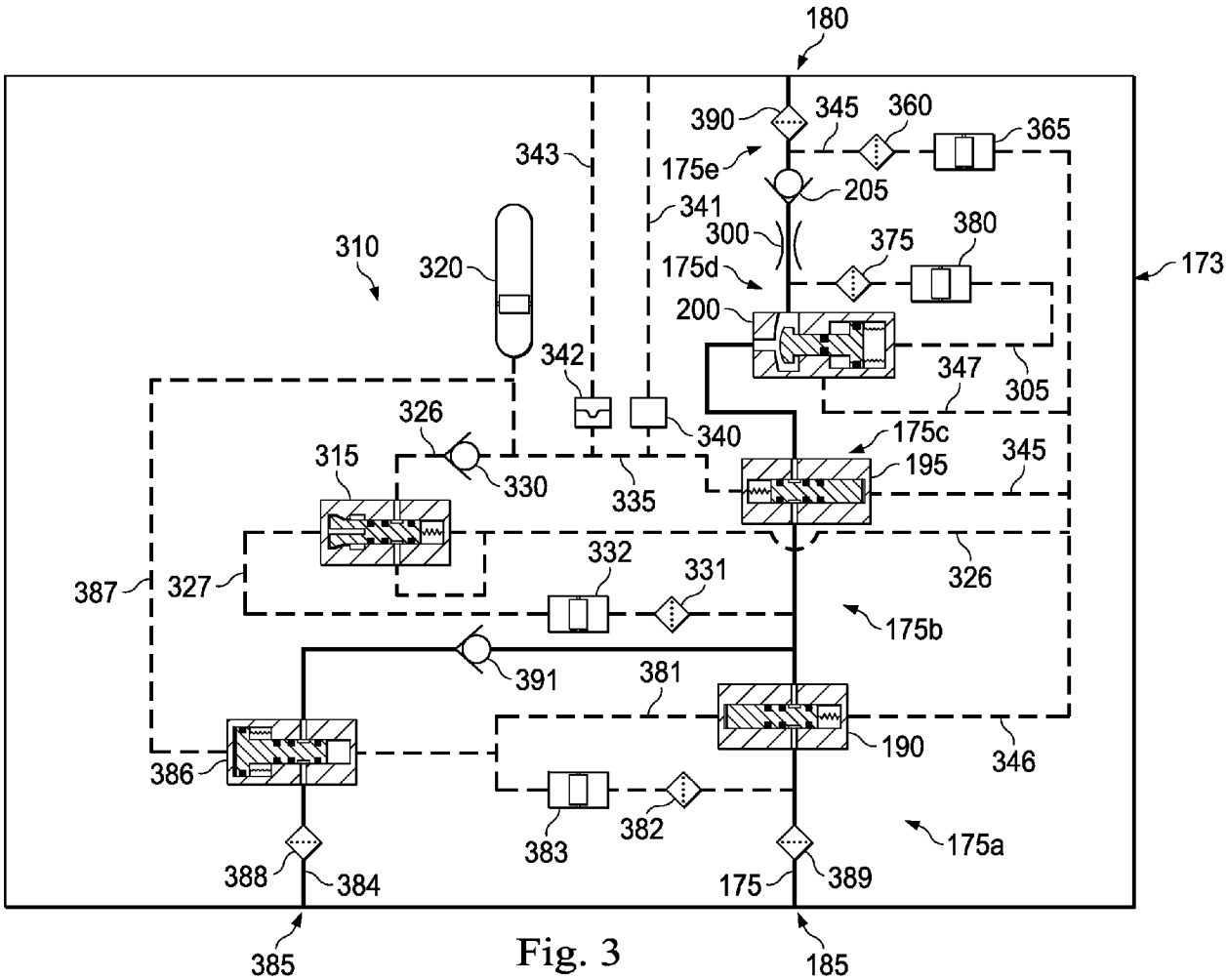
FIG. 3 is a hydraulic diagram of a first embodiment of the pressure maintenance device of FIG. 1, according to an exemplary embodiment of the present disclosure.

In one or more exemplary embodiments and illustrated in FIGS. 2A and 3, a first embodiment of the PMD 140 is a Dual Port PMD ("DPPMD") 173 that has an exterior surface 173*a* and an interior surface 173*b*. The DPPMD 173 may be located within the lower completion assembly 87 to fluidically connect the wellbore annulus 150 with the completion string annulus 165. In one or more exemplary embodiments, and as shown in FIG. 3, the DPPMD 173 may include a flow path 175 that extends from an opening 180 through the exterior surface 173*a* to an opening 185 through the interior surface 173*b* of the DPPMD 173 to fluidically connect the completion string annulus 165 and the wellbore annulus 150. The DPPMD 173 may include valves 190, 195, and 200 that are located along the flow path 175 and between the opening 185 and a check valve 205. In one or more exemplary embodiments, the valves 190, 195, and 200 control the flow of a fluid from the completion string annulus 165 to the wellbore annulus 150. In an exemplary embodiment, the valves 190 and 195 may be two-position spool valves that open or close based on a pressure differential. In one or more exemplary embodiments, the check valve 205 is located along the flow path 175 such that the fluid is prevented from flowing through the opening 180 and entering the valve 200. In one or more exemplary embodiments, the DPPMD 173 also includes a restrictor 300 located along the flow path 175 and between the check valve 205 and the valve 200. In one or more exemplary embodiments, the opening 185 of the DPPMD 173 is fluidically connected to the completion string annulus 165 within the first zone 110. In one or more exemplary embodiments, the valve 190 is located along the flow path 175 between the opening 185 and the valve 195. In one or more exemplary embodiments, the valve 195 is located along the flow path 175 between the valves 190 and 200. In one or more exemplary embodiments the valve 200 is located along the flow path 175 between the valve 195 and the opening 180.

In an exemplary embodiment, the flow path 175 forms a first section 175*a* that extends from the opening 185 to the valve 190, a second section 175*b* that extends from the valve 190 to the valve 195, a third section 175*c* that extends from the valve 195 to the valve 200, a fourth section 175*d* that extends from the valve 200 to the restrictor 300, and a fifth section 175*e* that extends from the check valve 205 to the opening 180.

In one or more exemplary embodiments, the valve 190 closes when a first pressure differential exceeds a first threshold pressure, such as for example 2,500 psi. In one or more exemplary embodiments, the first pressure differential is a pressure differential between an internal pressure, which is a pressure within the internal region, or the completion string annulus 165, and an external pressure, which is a pressure associated with the external region, or the wellbore annulus 150. Otherwise, and when the first pressure differential is less than 2,500 psi, the valve 190 is open to allow the fluid to flow through the flow path 175 from the first section 175*a* to the second section 175*b*. That is, when the internal pressure exceeds the external pressure by the first pressure differential, the valve 190 is closed. However, when the internal pressure exceeds the external pressure by an amount less than the first pressure differential, when the external pressure is equal to the internal pressure, and when the external pressure exceeds the internal pressure, the valve 190 remains open. In one or more exemplary embodiments, the first threshold pressure may be any predetermined pressure, such as for example 1,000 psi, 1,500 psi, 2,000 psi, 3,000 psi, 3,500 psi, or 4,000 psi.

In one or more exemplary embodiments, the valve 195 closes when a second pressure differential exceeds a second threshold pressure. Otherwise, the valve 195 remains open. In one or more exemplary embodiments, the second pressure differential is a pressure differential between the external pressure and a reference pressure. In one or more exemplary embodiments, the second threshold pressure may be any predetermined pressure, such as for example 100 psi, 200 psi, 300 psi, 400 psi, or 500 psi. In one or more exemplary embodiments, the second threshold pressure correlates to the desired pressure differential between the reservoir pressure and the pressure in the wellbore annulus 150. In an exemplary embodiment, the second threshold is 200 psi. In an exemplary embodiment, and when the reservoir pressure is 10,000 psi and the second threshold pressure is 200 psi, the ideal pressure within the wellbore annulus 150 is between 10,000 psi and 10,200 psi.

In one or more exemplary embodiments, the valve 200 is a flow control valve that opens when a third pressure differential exceeds a third threshold pressure. In an exemplary embodiment, the third threshold pressure is a pressure differential between the pressure within the third section 175*c* of the flow path 175 and the fourth section 175*d* of the flow path 175. In one or more exemplary embodiments, the third pressure differential may be any predetermined pressure, such as for example 50 psi. In an exemplary embodiment, the third pressure differential may be 150 psi. In one or more exemplary embodiments, the valve 200 controls the flow of the fluid through the flow path 175. For example, when the pressure within the third section 175*c* of the flow path 175 exceeds the pressure within the fourth section 175*d* of the flow path 175 by 150 psi, the valve 200 opens. In an exemplary embodiment and when the valve 200 is open, the fluid flows through the restrictor 300, which creates a back pressure that is communicated through a pilot line 305 as a feedback signal to flow control valve 200. In an example embodiment, this causes the valve 200 to move to create a higher pressure across the valve 200 thereby reducing the flow rate. In an exemplary embodiment, this continues until a stable value of flow rate is achieved, which will cause a spool in the valve 200 to remain in a stable state.

In one or more exemplary embodiments, the DPPMD 173 may also include a reference pressure assembly 310, which may include a valve 315 that controls the flow of a fluid into a pressurized fluid source, or an accumulator 320, from a pilot line 326 that extends between the accumulator 320 and the external region. In an exemplary embodiment, the valve 315 is also fluidically connected to the external region via the pilot line 326 and the second section 175*b* of the flow path 175 via a pilot line 327. In an exemplary embodiment, the fluid that pressurizes the accumulator 320 flows through the pilot line 326 towards the accumulator 320. In an exemplary embodiment, a fluid located within the wellbore annulus 150 pressurizes the fluid that flows through the pilot line 326 to pressurize the accumulator 320. In one or more exemplary embodiments, the accumulator 320 is pressurized to an initial pressure at the surface, such as for example using a fluid such as a nitrogen gas. A check valve 330 may form a portion of the pilot line 326 to prevent the flow of a fluid from the accumulator 320 and towards the valve 315. However, the check valve 330 may be omitted from the DPPMD 173. In one or more exemplary embodiments, a filtering device 331 and/or a piston 332 may form a portion of the pilot line 327. In an exemplary embodiments, a pilot line 335 extends between the accumulator 320 and the valve 195. In one or more exemplary embodiments, a pressure relief valve 340 is fluidically connected to the pilot line 335 and is configured to depressurize the reference pressure assembly 310 when the DPPMD 173 is pulled up to the surface. In an exemplary embodiment, the valve 315 may be a two-position spool valve having a latch feature that secures the valve 315 in the closed position. In an exemplary embodiment, the valve 315 closes when a fourth pressure differential exceeds a fourth threshold pressure, such as for example 100 psi. However, a variety of fourth threshold pressures are contemplated here. In an exemplary embodiment, the fourth threshold pressure is a pressure differential between the pressure within the second section 175*b* of the flow path 175 and the external pressure. In one or more exemplary embodiments, the fourth threshold pressure is less than the first threshold pressure so that the valve 315 will close prior to the valve 190 closing. In one or more exemplary embodiments, the accumulator 320 is a piston type accumulator such as for example, a gas-charged accumulator that is a hydraulic accumulator with gas as the compressible medium. In an exemplary embodiment, the pressure relief valve 340 is also connected to the external region via a pilot line 341. In an exemplary embodiment, the pressure relief valve 340 may be rated at 5,000 psi change of pressure, although a variety of pressure ratings are contemplated here. In an exemplary embodiment, the reference pressure assembly 310 may also include a rupture disk 342 that is fluidically connected to the pilot line 335 and the external region via a pilot line 343. In an exemplary embodiment, the rupture disk 342 may be rated at 7,000 psi, although a variety of pressure ratings are contemplated here.

In one or more exemplary embodiments, the DPPMD 173 may also include a pilot line 345 that extends between the external region and the valve 195. In one or more exemplary embodiments, the DPPMD 173 may also include a pilot line 346 that extends between the external region and the valve 190. In an exemplary embodiment, the DPPMD 173 may also include a pilot line 347 that extends from the pilot line 345 to the valve 200. A filtering device 360 and/or a piston 365 may form a portion of the pilot line 345. In an exemplary embodiment, a screen 375 and/or a piston 380 may form a portion of the pilot line 305. In one or more exemplary embodiments, the DPPMD 173 also includes a pilot line 381 extending between the internal region or the completion string annulus 165 (via the first portion 175*a* of the flow path 175) and the valve 190. A filtering device 382 and/or a piston 383 may form a portion of the pilot line 381.

In an exemplary embodiment, the DPPMD 173 also includes a flow path 384 that extends from an opening 385 that is exposed to a pressure within completion string annulus 165 to the second section 175*b* of the flow path 175. In an exemplary embodiment, a valve 386 may be located along the flow path 384. In one or more exemplary embodiments, a pilot line 387 extends between the accumulator 320 and the valve 386. In one or more exemplary embodiments, the valve 386 is fluidically connected to the pilot line 381. In an exemplary embodiment, the valve 386 may be a two-position spool valve that closes when a fifth pressure differential exceeds a fifth threshold pressure. In one or more exemplary embodiments, the fifth pressure differential is a difference between the pressure in the accumulator 320 and the internal pressure. That is, the fifth pressure differential is based on the reference pressure and the internal pressure. Generally, the valve 386 closes when the reference pressure exceeds the internal pressure by the fifth threshold pressure. In one or more exemplary embodiments, a filtering device 388 is located along the flow path 384 between the opening 385 and the valve 386. In an exemplary embodiment, the opening 185 and the opening 385 are spaced longitudinally along the lower completion assembly 87 such that the opening 185 is fluidically connected to the completion string annulus 165 at a location uphole from the sump packer 95 and the opening 385 is fluidically connected to the completion string annulus 165 at a location downhole from the sump packer 95. In one or more exemplary embodiments, the opening 385 is fluidically connected to the completion string annulus 165 at a location outside of the production zone. Thus, pressurized fluid within the completion string annulus 165 that is located downhole from the sump packer 95 may be used to pressurize the wellbore annulus 150 of the first zone 110, the second zone 115, and the third zone 120. Often, when the packers 100 and 105 are being set, the pressure within the completion string annulus 165 that is located uphole from the sump packer 95 may increase greatly, thus exceeding the first threshold pressure to close the valve 190. In order to continue pressurizing the external region, or the wellbore annulus 150 associated with the production zone of the lower completion system 87, while the isolation packers 100 and 105 are being set, pressurized fluid within the completion string annulus 165 that is located downhole from the sump packer 95 may flow through the flow path 384. In one or more exemplary embodiments, the DPPMD 173 may also include a filtering device 389 that may form a portion of the first section 175*a* of the flow path 175. In one or more exemplary embodiments, a filtering device 390 may form a portion of the fifth section 175*e* of the flow path 175. In one or more exemplary embodiments, the filtering devices 331, 360, 375, 382, 388, 389, and 390 may be any type of device to screens large solid particles, such as for example, a screen. In an exemplary embodiment, a check valve 391 may be located along the flow path 384 to prevent the fluid from flowing from the second section 175*b* of the flow path 175 to the valve 386.

Figure 4:
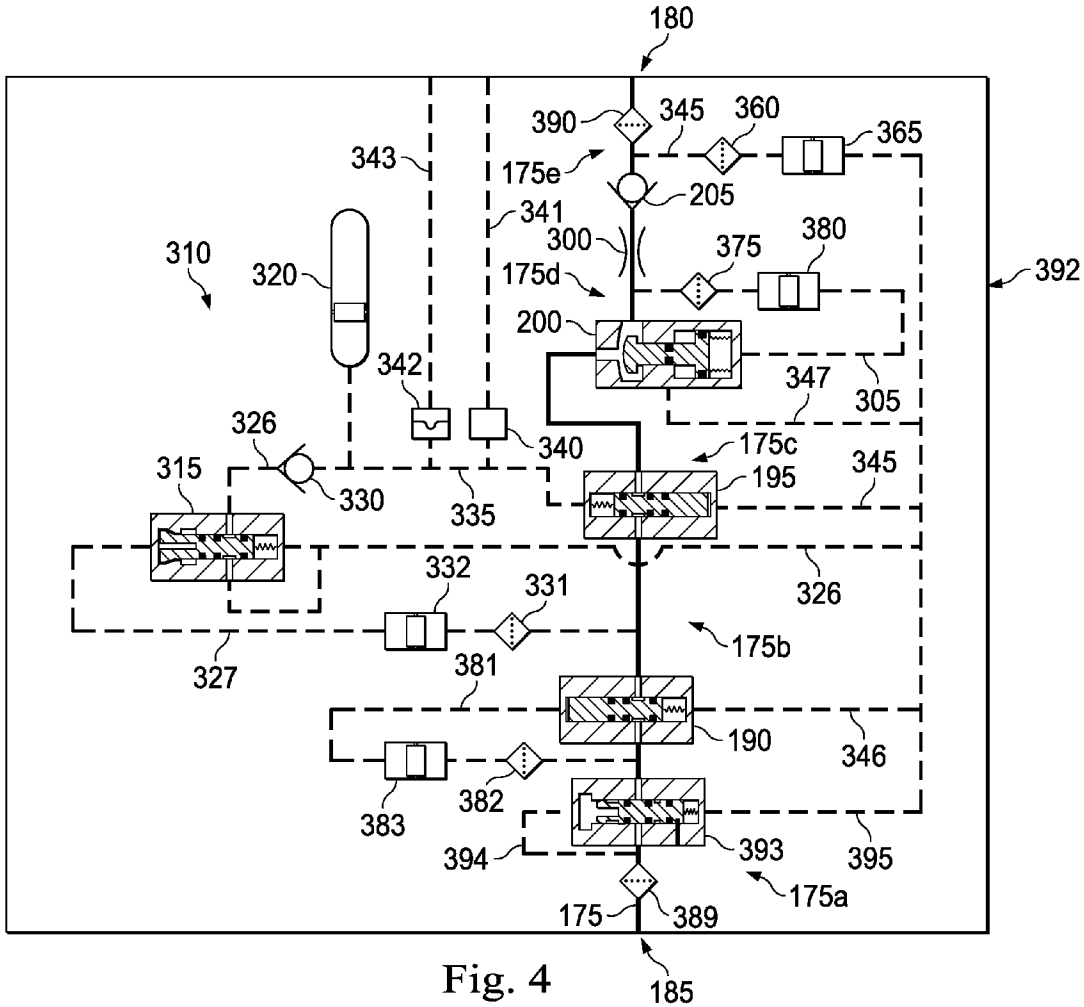
FIG. 4 is a hydraulic diagram of a second embodiment of the pressure maintenance device of FIG. 1, according to an exemplary embodiment of the present disclosure.

In one or more exemplary embodiments and illustrated in FIG. 4, a second embodiment of the PMD 140 is a Single Port PMD ("SPPMD") 392. In one or more exemplary embodiments, the SPPMD 392 has an exterior surface and an interior surface. In one or more embodiments, the SPPMD 392 is substantially similar to the DPPMD 173 except that the SPPMD 392 omits the flow path 384, the opening 385, the filtering device 388, the valve 386, the check valve 391, and the pilot line 387 and instead, may include a valve 393 located along the fluid line 175 and between the screen 389 and the valve 190. In an exemplary embodiment, the valve 393 is a two-position spool valve that is in an initially in a closed position. In an exemplary embodiment, the valve 393 may be in fluid communication with the internal pressure via a pilot line 394 and may be in fluid communication with the external pressure via a pilot line 395. In an exemplary embodiment, the valve 393 is held in the closed position using a shear pin. In an exemplary embodiment, the shear pin will shear when the valve 393 is exposed to a predetermined pressure differential, such as 500 psi. In an exemplary embodiment, the valve 393 includes a collet and corresponding groove that secures the valve 393 in the open position. In an exemplary embodiment, the opening 180 of the SPPMD 392 is formed through an exterior surface of the SPPMD 392 instead of the exterior surface 173*a* of the DPPMD 173 and the opening 185 is formed through the interior surface of the SPPMD 392 instead of the interior surface 173*b* of the DPPMD 173. In one or more exemplary embodiments, the opening 185 of the SPPMD 392 is fluidically connected to the internal region, or the completion string annulus 165, of the second zone 115.

In one or more exemplary embodiments, the PMD 140 in the third zone 120 is a SPPMD 392', which is substantially identical or identical to the SPPMD 392, and therefore the SPPMD 392' will not be described in further detail. Reference numerals used to refer to the features of the SPPMD 392 that are substantially identical to the features of the SPPMD 392' will correspond to the reference numerals used to refer to the features of the SPPMD 392. In one or more exemplary embodiments, the opening 185 of the SPPMD 392' is fluidically connected to the internal region, or the completion string annulus 165, of the third zone 120.

Figure 5:
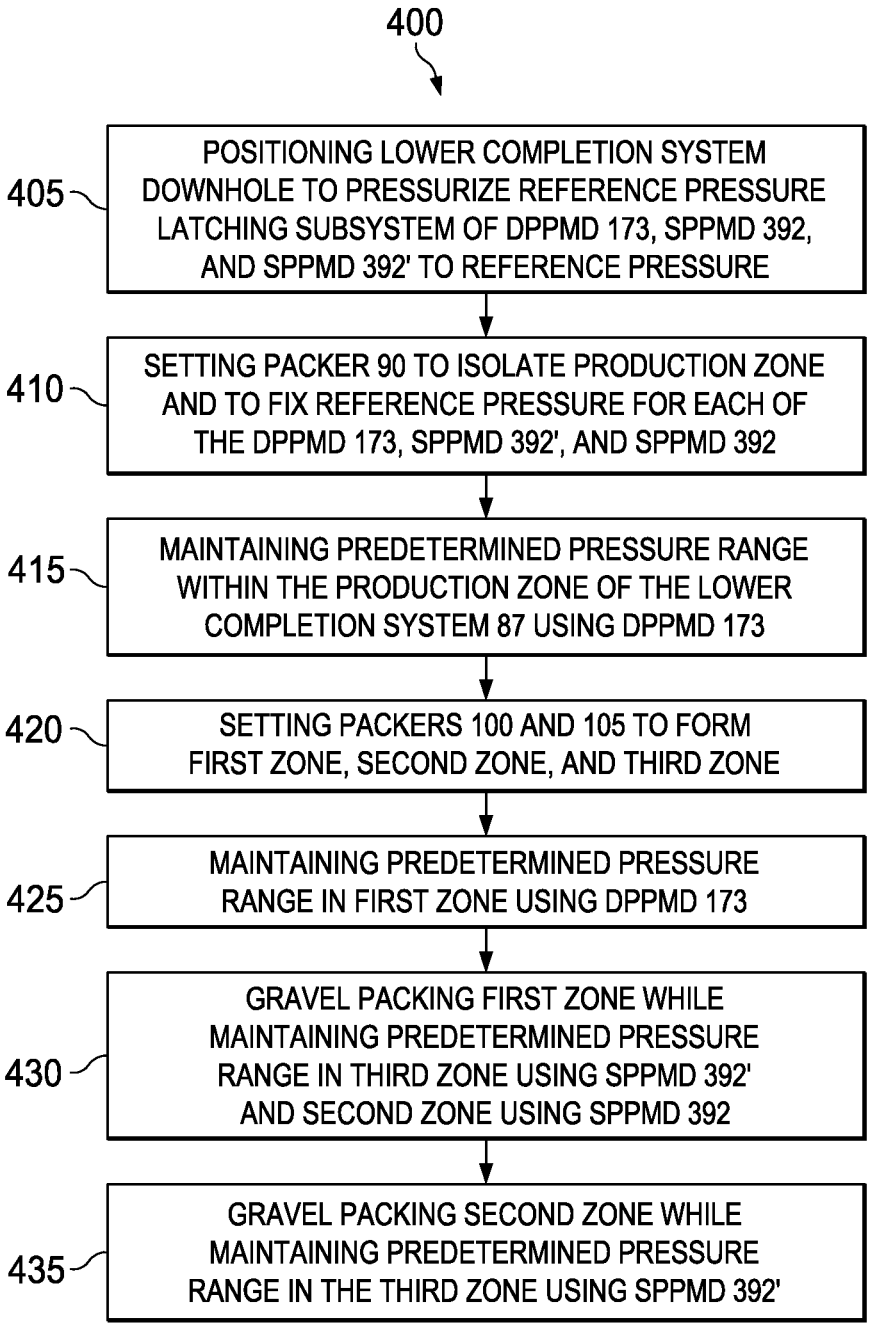
FIG. 5 is a flow chart illustration of a method of operation of the pressure maintenance devices of FIGS. 3 and 4, according to an exemplary embodiment of the present disclosure.

With reference to FIG. 5 and with continuing reference to FIGS. 1-4, in one or more embodiments, a method of operating the DPPMD 173, the SPPMD 392, and the SPPMD 392' is generally referred to by the reference numeral 400 and may include positioning the lower completion system 87 downhole to pressurize the reference pressure assembly 310 associated with each of the SPPMD 392, the SPPMD 392' and the DPPMD 173 at step 405; setting the packer 90 to isolate a production zone of the lower completion system 87 and to fix the reference pressure within the assemblies 310 of the SPPMD 392, the SPPMD 392', and the DPPMD 173 at step 410; maintaining a predetermined pressure range in the production zone of the lower completion system 87 using the DPPMD 173 at step 415; setting the isolation packers 100 and 105 to form the first zone 110, the second zone 115, and the third zone 120 at step 420; maintaining a predetermined pressure range in the first zone 110 using the DPPMD 173 at step 425; gravel packing the first zone 110 while maintaining the predetermined pressure range in the third zone 120 using the SPPMD 392' and in the second zone 115 using the SPPMD 392 at step 430; and gravel packing the second zone 115 while maintaining the predetermined pressure range in the third zone 120 using the SPPMD 392' at step 435.

At the step 405, the lower completion system 87 is positioned downhole to pressurize the assemblies 310 of the SPPMD 392', the SPPMD 392, and the DPPMD 173. Referring to FIG. 4, when the lower completion system 87 and the SPPMD 392 are lowered downhole, the valve 200 will open when the third pressure differential is exceeded. As the lower completion system 87 is positioned downhole, the first pressure differential does not exceed the first threshold pressure associated with the valve 190 and the valve 190 remains open. Additionally, the second pressure differential does not exceed the second threshold pressure associated with the valve 195 and the valve 195 remains open. Additionally, the fourth pressure differential does not exceed the fourth threshold pressure and the valve 315 remains open to allow for the accumulator 320 to be pressurized to the external pressure if the external pressure is greater than the initial pressure of the accumulator 320. In an exemplary embodiment, the fluid may be entering the accumulator 320 to pressurize the accumulator 320 when a depth of 20,000 ft. is achieved, however, this is dependent upon the initial pressure of the accumulator 320. In one or more exemplary embodiments, the lower completion system 87 may be an Enhanced Single-Trip Multizone ("ESTMZ™") System. As the lower completion system 87 extends downhole, the internal pressure and the external pressure increase and the fluid within the flow path 326 compresses a nitrogen-filled bladder to create the reference pressure within the accumulator 320 of the SPPMD 392. The reference pressure assemblies 310*s* of the DPPMD 173 and of the SPPMD 392' are pressurized in a substantially similar manner to pressurizing the reference pressure assembly 310 of the SPPMD 392 and therefore additional detail will not be provided here. In one or more exemplary embodiments, the reference pressure assembly 310 for each of the SPPMD 392, SPPMD 392' and DPPMD 173 may be pressurized to a different reference pressure, depending on the location of each of the SPPMD 392, SPPMD 392' and DPPMD 173 in the wellbore, along with a variety of other factors.

At the step 410, the packer 90 is set to isolate the production zone of the lower completion system 87 and to fix the reference pressures within each of the SPPMD 392', the SPPMD 392, and the DPPMD 173. In one or more exemplary embodiments, setting the packer 90 will isolate the production zone of the lower completion system 87 from the wellbore hydrostatic pressure. In one or more exemplary embodiments, setting the packer 90 includes increasing the internal pressure within the completion string annulus 165 so that the packer 90 may expand to fluidically isolate the wellbore annulus 150 of the production zone of the lower completion system 87 from the wellbore annulus 150 that is uphole from the packer 90. In one or more exemplary embodiments, the internal pressure may be increased to about 3,600 psi, however any internal pressure is contemplated here. In one or more exemplary embodiments, increasing the internal pressure can cause the fourth pressure differential to exceed the fourth threshold pressure to close the valve 315. In one or more exemplary embodiments, the valve 315 has a latching mechanism to prevent the valve 315 from reopening once the fourth pressure differential recedes below the fourth threshold pressure. Accordingly, the accumulator 320 and the pilot line 335 and a portion of the pilot line 326 can no longer be pressurized and the reference pressure is "set" or fixed at the pressure within the accumulator 320 when the valve 315 closes. In one or more exemplary embodiments, increasing the internal pressure can also cause the first pressure differential to exceed the first threshold pressure differential to close the valve 190.

At the step 415 and referring back to FIG. 3, the predetermined pressure range is maintained in the wellbore annulus 150 of the production zone of the lower completion system 87 using the DPPMD 173. In one or more exemplary embodiments, the predetermined pressure range is a pressure range equal to or greater than the highest reservoir pressure. Generally, and when the completion string annulus 165 is isolated from the wellbore annulus 150, isolating the production zone of the lower completion system 87 from the wellbore hydrostatic pressure will result in the reduction of the external pressure or depletion of a hydrostatic overbalance pressure, as the fluid within the wellbore annulus 150 seeps or leaks into the surrounding formation 20. If the external pressure continues to recede, then the wellbore 80 may collapse if it is an open hole wellbore. Alternatively, the filter cake may collapse. If the wellbore 80 is a cased hole, formation sands from one portion of the production zone may enter the annulus and exit the production zone in another portion of the production zone to mix formation sands. In one or more exemplary embodiments, and due to the increased internal pressure within the completion string annulus 165 on the uphole side of the sump packer 95 (i.e., the first zone 110), the valve 190 of the DPPMD 173 may be closed. Due to the opening 385 and flow path 384 fluidically connecting the DPPMD 173 to the completion string annulus 165 at a location that is on the downhole side of the sump packer 95, fluid from the downhole side of the sump packer may be used to pressurize the wellbore annulus 150 when the fifth pressure differential is not exceeded. Assuming that the reference pressure is less than the internal pressure during the step 415, the valve 386 will be open. That is, the flow path 384, the opening 385, and the valve 386 allow for the DPPMD 173 to pressurize the wellbore annulus 150 even while the internal pressure of the completion string annulus 165 associated with the first zone 110, the second zone 115, and the third zone 120 exceed the first threshold pressure.

Figure 6:
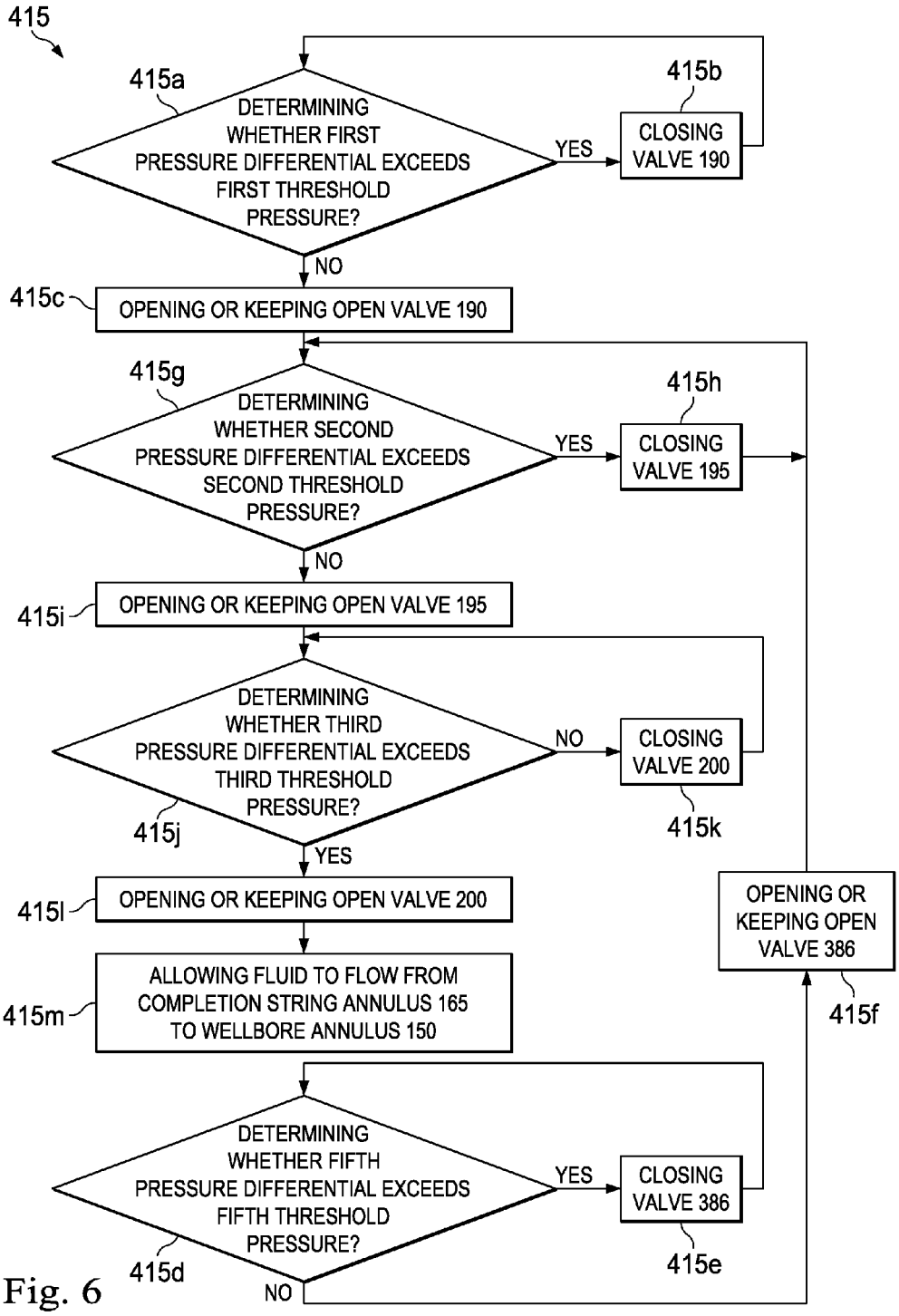
FIG. 6 is a flow chart diagram of a step of the method of FIG. 5, according to an exemplary embodiment of the present disclosure.

In one or more exemplary embodiments and as illustrated in FIG. 6, the step 415 includes one or more of sub-steps of determining whether the first pressure differential exceeds the first threshold pressure at step 415*a*, if so, closing the valve 190 at step 415*b* and returning to the step 415*a* and if not, opening or keeping the valve 190 open at step 415*c*, and simultaneously, determining whether the fifth pressure differential exceeds the fifth threshold pressure at step 415*d*, if so, closing the valve 386 at step 415*e* and returning to the step 415*d*, and if not, opening or keeping open the valve 386 at step 415*f*, then after the steps 415*a*, 415*b*, 415*c*, 415*d*, 415*e*, and 415*f*, determining whether the second pressure differential exceeds the second threshold pressure at step 415*g*, if yes, closing the valve 195 at step 415*h* and returning to the step 415*g*, if no, opening or keeping open the valve 195 at step 415*i*, determining whether the third pressure differential exceeds the third threshold pressure at step 415*j*, if not, closing the valve 200 at step 415*k* and returning to step 415*j*, and if so, opening or keeping the valve 200 open at step 415*l*, and allowing fluid to flow from the completion string annulus 165 to the wellbore annulus 150.

Returning to FIG. 5 and at the step 420, the packers 100 and 105 are set to form the first zone 110, the second zone 115, and the third zone 120 of the production zone of the lower completion system 87. In one or more exemplary embodiments, the internal pressure increases to up to about 5,000 psi when the packers 100 and 105 are set, which closes the valve 190 but not the valve 386 (as the opening 385 is not exposed to the 5,000 psi pressure).

At the step 425, the predetermined pressure range is maintained within the first zone 110 using the SPPMD 173. In an exemplary embodiment, the step 425 is identical to the step 415 and therefore, no additional detail will be provided here. However, as the production zone is now separated into the first zone 110, the second zone 115, and the third zone 120, the SPPMD 173 can only maintain the first zone 110 within the predetermined pressure range.

Figure 7:
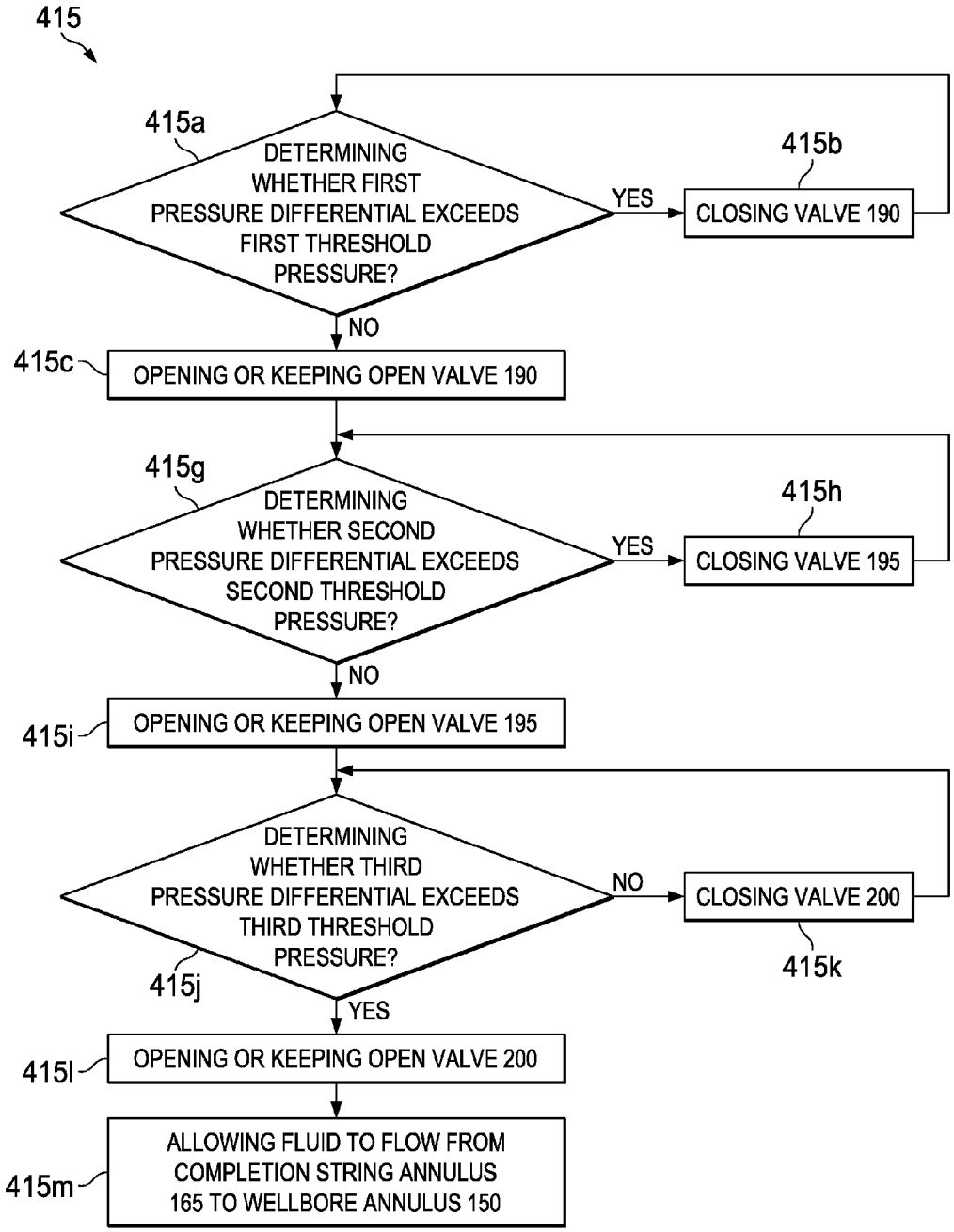
FIG. 7 is a flow chart diagram of another step of the method of FIG. 5, according to an exemplary embodiment of the present disclosure.

At the step 430, the first zone 110 is gravel packed while the predetermine pressure range is maintained in the second zone 115 using the SPPMD 392 and the predetermined pressure range is maintained in the third zone 120 using the SPPMD 392'. In one or more exemplary embodiments, maintaining the predetermined pressure range in the third zone 120 using the SPPMD 392' and maintaining the predetermined pressure range in the second zone 115 using the SPPMD 392 is identical to maintaining the predetermined pressure range in the production zone using the DPPMD 173 except the sub-steps 415*d*, 415*e*, and 415*f* are omitted, as shown in FIG. 7. That is, the step of maintaining the predetermined pressure range in the third zone 120 using the SPPMD 392' and/or maintaining the predetermined pressure range in the second zone 115 using the SPPMD 392 includes one or more of sub-steps of determining whether the first pressure differential exceeds the first threshold pressure at the step 415*a*, if so, closing the valve 190 at the step 415*b* and returning to the step 415*a* and if not, opening or keeping the valve 190 open at the step 415*c*, determining whether the second pressure differential exceeds the second threshold pressure at the step 415*g*, if yes, closing the valve 195 at the step 415*h* and returning to the step 415*g*, if no, opening or keeping open the valve 195 at the step 415*i*, determining whether the third pressure differential exceeds the third threshold pressure at the step 415*j*, if no, closing the valve 200 at the step 415*k* and returning to the step 415*j*, and if so, opening or keeping the valve 200 open at the step 415*l*, and allowing fluid to flow from the completion string annulus 165 to the wellbore annulus 150 at the step 415*m*. In an exemplary embodiment, maintaining the predetermined pressure range in the third zone 120 using the SPPMD 392' and/or maintaining the predetermined pressure range in the second zone 115 using the SPPMD 392 may occur at any time when the valves 190, 195, and 200 open. In one or more exemplary embodiments and during the step 430, a tool opens a port within the working string 75 that forms part of the first zone 110 to pump a slurry into the wellbore annulus 150 of the first zone 110. In one or more exemplary embodiments and while the first zone 110 is being gravel packed, the SPPMD 392 maintains the second zone 115 within the predetermined pressure range in the manner described in the step 430 and the SPPMD 392' maintains the third zone 120 at the predetermined pressure range in the manner described in the step 430. In an exemplary embodiment, the fluid entering a screen associated with the first zone 110 flows through the completion string annulus 165 in the second zone 115 and the third zone 120 and the SPPMD 392 and/or the SPPMD 392' may use this fluid to pressurize the wellbore annulus 150 associated with each of the second zone 115 and the third zone 120. Once the first zone 110 is gravel packed or frac-packed and ready for production, the risk of wellbore collapse is less and the DPPMD 173 is not required to maintain the first zone 110 within the predetermined pressure range.

Referring back to FIG. 5 and at the step 435, the second zone 115 is gravel packed or frac-packed while the predetermine pressure range is maintained in the third zone 120 using the SPPMD 392'. The step of maintaining the predetermined pressure range in the third zone 120 using the SPPMD 392' at the step 435 is identical to maintaining the predetermined pressure range in the second zone 115 using the SPPMD 392' at the step 430. Once the second zone 115 is gravel packed or frac-packed and ready for production, the risk of wellbore collapse is less and the SPPMD 392 is not required to maintain the second zone 115 at the predetermined pressure range.

The process continues until each of the first zone 110, the second zone 115, and the third zone 120 of the production zone is gravel packed and/or frac-packed.

In an exemplary embodiment, a PMD 140 identical to the SPPMD 392 may be used in place of the DPPMD 173 and the steps 415 and 425 are omitted from the method 400. In an exemplary embodiment, the method 400 may also include a method of testing the lower completion system 87 at or near the surface. In an exemplary embodiment, the lower completion system 87 is lowered downhole to a first distance, for example, to 300 feet downhole. In an exemplary embodiment, the fluid is then flowed through the completion string annulus 165 and the pressure in the completion string annulus 165 and/or the wellbore annulus 150 is increased to a pressure less than the pressure differential associated with the valve 393, such as 500 psi. The pressure within the completion string annulus 165 and/or the wellbore annulus 150 is monitored while the valve 393 remains closed. Thus, the lower completion system 87 may be tested for leaks or other issues. Once the testing of the lower completion system 87 is complete, the interior pressure within the completion string annulus 165 may be increased such that the pressure differential associated with the valve 393 is exceed. In an exemplary embodiment, and once the pressure differential associated with the valve 393 is exceeded, the shear pin in the valve 393 is sheared and the collet is secured in the groove to lock the valve 393 in an open position.

In an exemplary embodiment, the pressure relief valve 340 and the rupture disk 342 are safety features useful in the event the lower completion system 87 is returned to the surface. In an exemplary embodiment, and when the pressure within the pressure assembly 310 has been "set" or fixed at 10,000 psi, a pressure differential between the pressure assembly 310 and the exterior region increases as the depth of the lower completion system 87 is reduced. Once the pressure differential reaches the rating of the pressure relief valve 340, such as 5,000 psi, the pressure relief valve 340 opens to decrease the pressure within the pressure assembly 310. In an exemplary embodiment and if the pressure relief valve 340 fails, then when the pressure differential reaches the rating of the rupture disc 342, such as 7,000 psi, the rupture disc 342 ruptures to decrease the pressure within the pressure assembly 310.

In one or more embodiments, each of the first, second, third, fourth, and fifth threshold pressures is a function of springs used within the valves 190, 195, 200, 315, and 386, respectively. In one or more exemplary embodiments, each spring constant and the initial pre-compression of the springs within the valves 190, 195, 200, 315, and 386 is selected to achieve a predetermined pressure differential threshold for each of the valves 190, 195, 200, 315, and 386. In an exemplary embodiment, the valves 190, 195, 200, 315, 386, and 393 include a pressure differential sensor that may include a spring and spool. In an exemplary embodiment, each of the valves 190, 195, 200, 315, 386, and 393 measures and compares two pressures using the spring and the spool. In an exemplary embodiment, the pilot lines 346 and 381 are in fluid communication with the pressure differential sensor of the valve 393. In an exemplary embodiment, the pilot lines 327 and 326 are in fluid communication with the pressure differential sensor of the valve 315. In an exemplary embodiment, the pilot lines 335 and 345 are in fluid communication with the pressure differential sensor of the valve 195. In an exemplary embodiment, the pilot line 380 and the flow path 175 are in fluid communication with the pressure differential sensor of the valve 200. In an exemplary embodiment, the pilot lines 387 and 381 are in fluid communication with the pressure differential sensor of the valve 386. In an exemplary embodiment, the pilot lines 394 and 395 are in fluid communication with the pressure differential sensor of the valve 393. In one or more exemplary embodiments, the DPPMP 173, the SPPMD 392, and the SPPMD 392' form a portion of a wall of the working string 75 and each of the components (i.e., the valves 190, 195, 200, 315, 386) are of the cartridge type configuration. In one or more exemplary embodiments, the predetermined pressure range for each of the first zone 110, the second zone 115, and the third zone 120 is different and dependent upon each zone's formation, depth, etc.

In one or more embodiments, the method 400 may be used to maintain a certain desired excess pressure above the reservoir pressure in the wellbore annulus 150 to prevent or at least reduce uncontrolled fluid production into any part of the first zone 110, the second zone 115, and the third zone 120. In one or more exemplary embodiments, the method 400 encourages maintaining the wellbore annulus 150 in a clean state to prevent premature blocking of a proppant during a frac-pack or gravel pack operation. In one or more exemplary embodiments, the method 400 prevents or at least reduces the likelihood of the wellbore 80 collapsing in the case of an unconsolidated formation. In one or more exemplary embodiments, the method 400 may maintain the external pressure in the wellbore annulus 150 for an indefinite amount of time.

The present disclosure may be altered in a variety of ways. For example, the reference pressure assembly 310 may be omitted from the DPPMD 173, the SPPMD 392, and/or the SPPMD 392' and be replaced by a pressure system that is structurally configured to be charged to an estimated reservoir pressure at the surface of the well, such as for example an accumulator that is charged at the surface of the well. In one or more exemplary embodiments, the DPPMD 173, the SPPMD 392, and the SPPMD 392' or any combination thereof may include an isolation sleeve (not shown) that extends within the completion string annulus 165 and may be moved into a position to block the openings 185 or 385 or both.

Figure 8:
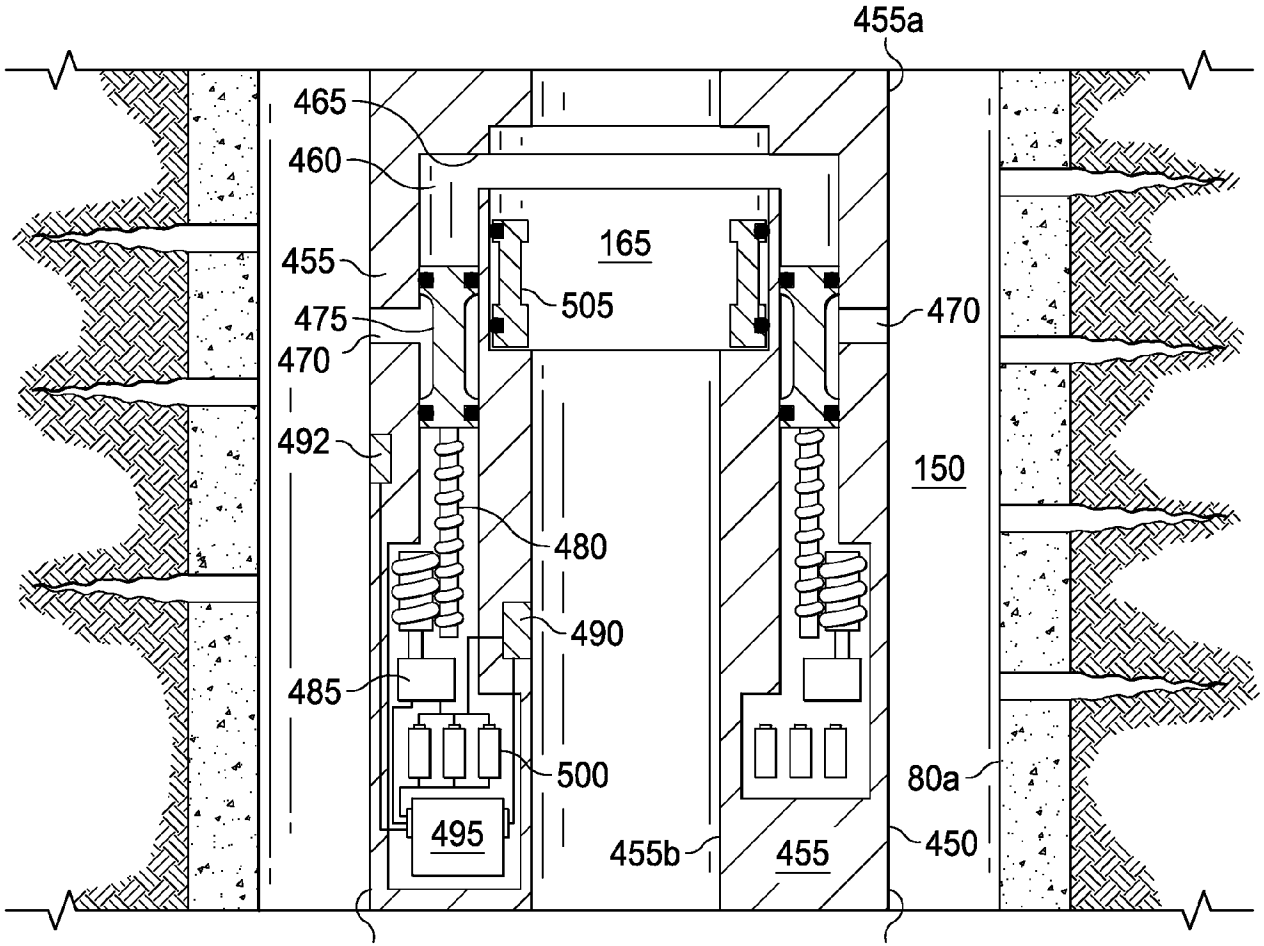
FIG. 8 is a section view of a third embodiment of the pressure maintenance device of FIG. 1, according to an exemplary embodiment of the present disclosure, the pressure maintenance device including a controller.
Figure 8A:
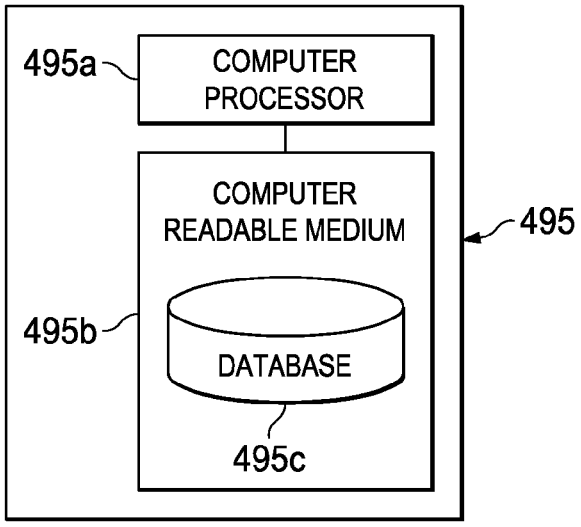
FIG. 8A is a schematic illustration of the controller, according to an exemplary embodiment of the present disclosure.

In one or more exemplary embodiments and illustrated in FIG. 8, another embodiment of the PMD 140 is an Electronic PMD ("EPMD") 450. In one or more exemplary embodiments, the EPMD 450 includes a tubing 455 that has an exterior surface 455*a* and an interior surface 455*b*. In one or more exemplary embodiments, a fluid path 460 is formed within a wall of the tubing 455 and extends between an opening 465 in the interior surface 455*b* and an opening 470 formed in the exterior surface 455*a*. In an exemplary embodiment, the fluid path 460 fluidically connects the wellbore annulus 150 with the completion string annulus 165. In one or more exemplary embodiments, a piston valve 475 is attached to a screw drive 480 that is coupled to a motor 485 and positioned within the fluid path 460 such that activation of the screw drive 480 by the motor 485 moves the piston valve 475 to block the fluid path 460 (as shown in FIG. 8) or open the fluid path 460 (not shown). Alternatively, a piston may be attached to a piston/cylinder arrangement that is coupled to an electrically powered pump. The EPMD 450 may also include a pressure sensor 490 that is exposed to the completion string annulus 165, a pressure sensor 492 that is exposed to the wellbore annulus 150, and a controller 495 that is operably connected and/or controls the motor 485 and/or the pressure sensors 490 and 492. As illustrated in FIG. 8A, the controller 495 also includes a computer processor 495*a* and a computer readable medium 495*b* operably coupled thereto. Instructions accessible to, and executable by, the controller 495 are stored on the computer readable medium 495*b*. In one or more embodiments, a database 495*c* is also stored in the computer readable medium 495*b*. In one or more exemplary embodiments, data is stored in the database 495*c*. In one or more exemplary embodiments, the data stored in the database 495*c* may include: data relating to the predetermined pressure range; data relating to an ECHO communication methods, etc. However, a variety of other data may also be stored in the database 495*c*. In one or more exemplary embodiments, the EPMD 450 also includes a power source 500, such as for example batteries. However, any type of power source 500 is contemplated here. In one or more exemplary embodiments, the EPMD 450 also includes an isolation sleeve 505 that is slideable along the interior surface 455*b* of the EPMD 450 from an open position in which the opening 465 is not obstructed by the isolation sleeve 505 to a closed position in which the opening 465 is obstructed by the isolation sleeve 505. In one or more exemplary embodiments, the isolation sleeve 505 is located in the open position when the working string 75 is placed downhole. In one or more exemplary embodiments, the isolation sleeve 505 is structurally configured to couple to a downhole tool, such as a shifting tool, to move the isolation sleeve 505 from the open position to the closed position and thereby permanently block the opening 465 and fluid path 460. In one or more exemplary embodiments, the EPMD 450 is located within the working string 75.

Figure 9:
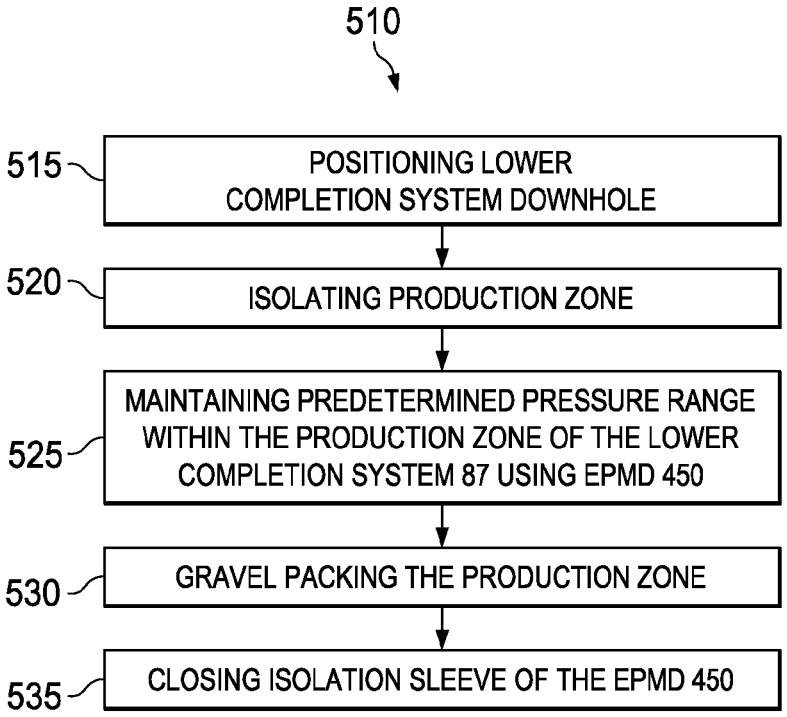
FIG. 9 is a flow chart diagram of a method of operation of the pressure maintenance device of FIG. 8, according to an exemplary embodiment of the present disclosure.

With reference to FIG. 9 with continuing reference to FIG. 8, in one or more embodiments, a method of operating the EPMD 450 is generally referred to by the reference numeral 510 and may include positioning the lower completion system 87 including the EPMD 450 downhole at step 515; isolating a production zone of the lower completion system 87 at step 520; maintaining the predetermined pressure range in the production zone of the lower completion system 87 using the EPMD 450 at step 525; gravel packing the production zone at step 530; and closing the isolation sleeve 505 of the EPMD 450 at step 535.

At the step 515, the lower completion system 87, which includes the EPMD 450, is positioned downhole. In one or more exemplary embodiments, the isolation sleeve 505 is in the open position when the lower completion system 87 is positioned downhole.

At the step 520, the production zone of the lower completion system 87 is isolated from the wellbore hydrostatic pressure formed within the wellbore 80. In one or more exemplary embodiments, the lower completion system 87 is isolated by the setting of a packer, such as the packer 90.

At the step 525, the predetermined pressure range is maintained in the production zone using the EPMD 450. In one or more exemplary embodiments, maintaining the predetermined pressure range in the production zone using the EPMD 450 includes the controller 495 determining whether the external pressure within the wellbore annulus 150 as measured by the pressure sensor 492 is less than the predetermined pressure range. If the external pressure within the wellbore annulus 150 as measured by the pressure sensor 492 is within the predetermined pressure range or exceeds the predetermined pressure range, the controller 495 may activate the motor 485 to move the screw drive 480 and the piston valve 475 to block the flow path 465 such that fluid from the completion string annulus 165 does not flow to the wellbore annulus 150. If the external pressure within the wellbore annulus 150 as measured by the pressure sensor 492 is below the predetermined pressure range (and assuming the internal pressure as measured by the pressure sensor 490 is greater than the external pressure), the controller 495 may activate the motor 485 to move the screw drive 480 and the piston valve 475 to open the flow path 465 such that the fluid may flow from the completion string annulus 165 to the wellbore annulus 150. In an exemplary embodiment, the piston valve 475 may also be partially closed or partially opened to choke the flow of the fluid from the completion string annulus 165 to the wellbore annulus 150. In an exemplary embodiment, choking the flow of the fluid from the completion string annulus 165 to the wellbore annulus 150 allows the production zone to be pressurized even when the interior pressure exceeds the predetermined pressure range. In one or more exemplary embodiments, instructions may be sent from the surface to the controller 495 using the pressure sensor 490 and a telemetry system such as, for example, a mud pulse telemetry system. However, the EPMD 450 may be structurally configured to communicate with any telemetry system, such as for example an electromagnetic, an acoustic, a torsion, or a wired drill pipe telemetry system. The instructions received by the controller 495 may include instructions to open, close, or choke the fluid path 460. In one or more exemplary embodiments, the piston valve 475 may be partially opened when the internal pressure in the completion string annulus 165, as measured by the pressure sensor 490, is greater than the predetermined pressure range, to choke the flow into the wellbore annulus 150. In one or more exemplary embodiments, the instructions received by the pressure sensor 490 may include a new predetermined pressure range. In an exemplary embodiment, the predetermined pressure range is defined by a minimum pressure and a maximum pressure.

At the step 530, the production zone is gravel packed or frac-packed. Once the wellbore annulus 150 of the production zone is gravel packed or frac-packed, the risk of formation collapse is reduced.

At the step 535, the isolation sleeve of the EPMD 450 is closed. In one or more exemplary embodiments, the downhole tool, such as the shifting tool, is accommodated within the working string 75 during gravel pack or frac-pack operations. When the gravel pack or frac-pack operations are completed, the shifting tool may move uphole. During this movement uphole, the shifting tool couples to the isolation sleeve 505 and moves the isolation sleeve 505 from the open position to the closed position. In one or more exemplary embodiments, moving the isolation sleeve 505 to the closed position may prevent or at least discourage fluid flow through the fluid path 460 during production operations.

In one or more embodiments, the method 510 may be used to maintain a certain desired excess pressure above the reservoir pressure in the wellbore annulus 150 to prevent or at least reduce uncontrolled fluid production into any part of the production zone. In one or more exemplary embodiments, the method 510 encourages maintaining the wellbore annulus 150 in a clean state to prevent premature blocking of the proppant during a frac-pack or gravel pack operation. In one or more exemplary embodiments, the method 510 prevents or at least reduces the likelihood of the wellbore 80 collapsing in the case of an unconsolidated formation. In one or more exemplary embodiments, the method 510 may maintain the external pressure in the wellbore annulus 150 for an indefinite amount of time. In an exemplary embodiment, the method 510 may be used to maintain the predetermined pressure range during a variety of operations, such as for example, during the setting of the isolation packer, zone pressure testing, frac packing lower zones, and reversing out lower zones following the frac pack. In an exemplary embodiment, the method 510 will prevent or at least reduce the likelihood of cross flow between production zones and cross flow within one production zone. In one or more exemplary embodiments, the method 510 may also prevent or at least reduce the likelihood of over-pressurizing the formation 20.

The present disclosure may be altered in a variety of ways. For example, the EPMD 450 may include a Radio-frequency identification ("RFID") reader or scanner such that when the shifter tool, which may include a RFID tag, passes near the RFID reader on the EPMD 450, the controller 495 would move the valve piston 475 to block the fluid path 460 regardless of the external pressure as measured by the pressure sensor 492. In one or more exemplary embodiments, if the shifter tool is tripped back down again, the RFID tag may signal the EPMD 450 to being maintaining the predetermined pressure range within the production zone. In one or more exemplary embodiments, the EPMD 450 may be configured to include a cartridge rod piston valve. In one or more exemplary embodiments, the EPMD 450 includes any valve that is controlled by an electronic module and pressure sensor. Additionally, each production zone with a multi-zone completion system may be associated with one (or more) EPMD 450. In another exemplary embodiment, the EPMD 450 may also include a filter (not shown) located between the completion string annulus 165 and the piston valve 475. In an exemplary embodiment, the piston valve 475 acts as a flow limiter and the EPMD 450 also includes a check valve (not shown) located between the piston valve 475 and the wellbore annulus 150. In an exemplary embodiment, the database 495*c* may store data relating to a reference pressure that is input at the surface or updated while the EPMD 450 is downhole using the telemetry system. That is, the controller 495 may receive instructions or an updated predetermined pressure range from a surface system by using pressure pulses detected in the internal region as measured by the pressure sensor 490. In an exemplary embodiment, the EPMD 450 may "report" the reservoir pressure to the surface or other pressure to the surface. In an exemplary embodiment, the EPMD 450 may also include a timer (not shown) that is included in the controller 495 or that may communicate with the controller 495, with the operation of the piston valve 475 dependent upon a time variable measured by the timer. In an exemplary embodiment, the EPMD 450 may be used to determine the location of the EPMD 450. For example, if the controller 495 communicates with a surface system that the external pressure or the internal pressure or both reaches a steady state, then this steady state could correspond to a desired location of the EPMD 450 within the wellbore 80. In an exemplary embodiment, data or instructions can be sent from the telemetry system or other system to the controller 495 to shut down the piston valve 475 during an unsafe event or other event. That is, the EPMD 450 may be actuated remotely. In an exemplary embodiment, the EPMD 450 may "report" localized downhole conditions to the surface, such as for example, a filter plug.

Figure 10:
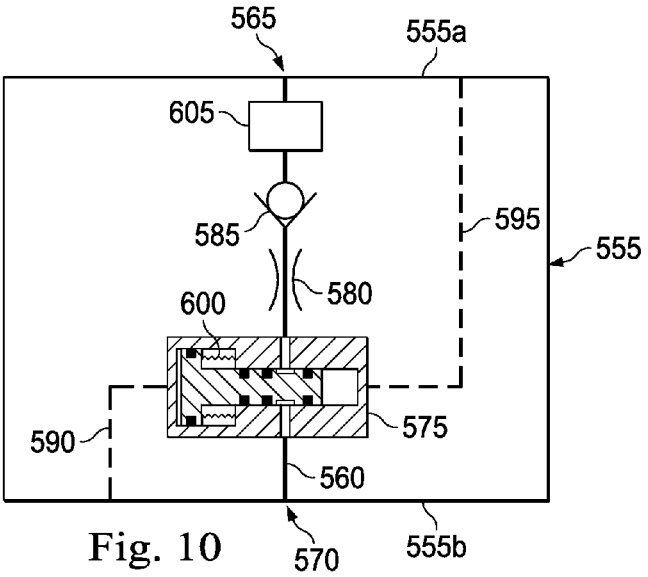
FIG. 10 is a hydraulic diagram of a fourth embodiment of the pressure maintenance device of FIG. 1, according to an exemplary embodiment of the present disclosure.
Figure 11:
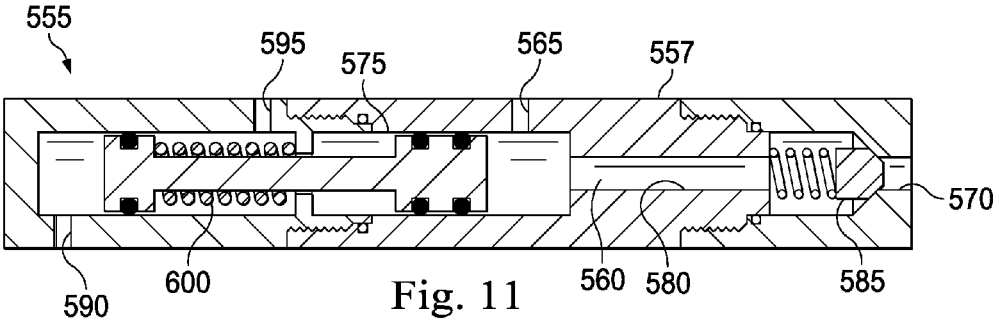
FIG. 11 is a section view of the fourth embodiment of the pressure maintenance device of FIG. 1, according to an exemplary embodiment of the present disclosure.

In one or more exemplary embodiments and illustrated in FIGS. 10 and 11, another embodiment of the PMD 140 is an Mechanical PMD ("MPMD") 555. In one or more exemplary embodiments, the MPMD 555 includes a tubing 557 that is at least partially exposed to the external region and is at least partially exposed to the internal region. In one or more exemplary embodiments, a flow path 560 extends from an opening 565 that is in fluid communication with the external region and to an opening 570 that is in fluid communication with internal region. The MPMD 555 may include a valve 575 located along the flow path 560 such that the valve 575 controls the flow of a fluid through the flow path 560. In one or more exemplary embodiments, the MPMD 555 may also include a flow regulator 580 and a check valve 585 that form a portion of the flow path 560. In an exemplary embodiment, the check valve 585 prevents the fluid from flowing from the external region through the opening 570. In one or more exemplary embodiments, the MPMD 555 may also include a pilot line 590 that extends between the internal region and the valve 575. In one or more exemplary embodiments, the MPMD 555 may also include a pilot line 595 that extends between the external region and the valve 575. In one or more exemplary embodiments, the valve 575 may be a two-position spool valve that closes when a pressure differential exceeds a pressure threshold. In an exemplary embodiment, the valve 575 measures and compares the internal pressure and the external pressure. In one or more exemplary embodiments, the pressure differential is the difference between the internal pressure and external pressure. In one or more exemplary embodiments, the pressure threshold is a function of a spring 600 within the valve 575. In one or more exemplary embodiments, the spring constant of the spring 600 and the initial pre-compression of the spring 600 is selected to achieve the pressure threshold for the valve 575. In one or more exemplary embodiments, the flow regulator 580 is a tube that effects the flow rate of the fluid passing through the flow regulator 580 based on the diameter and length of the tube. In one or more exemplary embodiments, the flow regulator 580 may be any one of a orifice, nozzle, helix, tortuous path, or other device or structure that regulates the flow of the fluid flowing through the flow path 560. In one or more exemplary embodiments, the MPMD 555 may also include a blocking member, or a lock out device ("LOD") 605 (not shown in FIG. 11), to permanently close or block the flow path 560.

Figure 12:
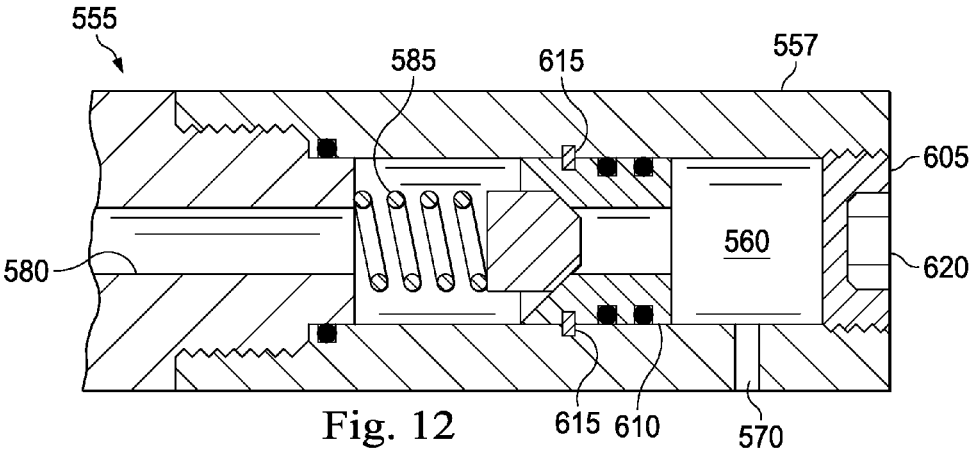
FIG. 12 is a section view of a of a portion of a fifth embodiment of the pressure maintenance device of FIG. 1, according to an exemplary embodiment of the present disclosure.

In another exemplary embodiment, and as shown in FIG. 12, the LOD 605 includes a magnetic valve seat 610 that is located along the flow path 560 such that the flow path 560 is unobstructed by the magnetic valve seat 610 when the magnetic valve seat 610 is secured in a first position using shear pins 615 but moves to obstruct the flow path 560 when moved to a second position. When moved into the second position, the shear pins 615 are sheared and the valve seat 610, which may be composed of a magnetic or ferromagnetic materials, rests against a magnet 620 or a collet ring, which secures the magnetic valve seat 610 to the magnet 620. However, a wide variety of components and materials are contemplated here. For example, the valve seat 610 may be composed of a magnet and the collet ring may be composed of a ferromagnetic material or a ferromagnetic materials may be disposed in the tubing 557 such that the valve seat 610 blocks the flow path 560 when the valve seat 610 is secured against the ferromagnetic materials.

Figure 13:
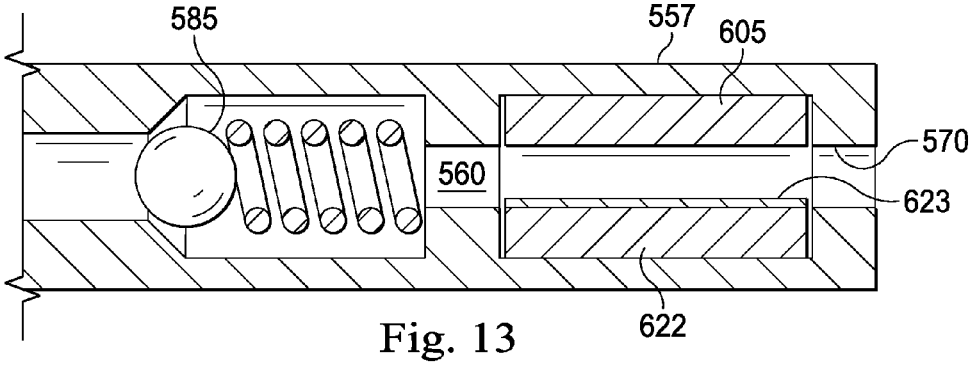
FIG. 13 is a section view of a portion of a sixth embodiment of the pressure maintenance device of FIG. 1, according to an exemplary embodiment of the present disclosure.

In one or more exemplary embodiments and as illustrated in FIG. 13, the LOD 605 is a swellable elastomer 622, such as for example, a cylinder of rubber swells located along the flow path 560 that swell to close or block the flow path 560. In one or more exemplary embodiments, an interior surface of the swellable elastomer 622 defines a portion of the flow path 560 when the swellable elastomer 622 is in a first configuration, or in the open position. In one or more exemplary embodiments, the swellable elastomer 622 swells to a second configuration, or a closed position, such that the interior surfaces meet to block the flow path 560. In one or more exemplary embodiments, a rod or other structure 623 is located proximate the interior surface of the swellable elastomer 622 to encourage the blocking of the flow path 560 when the swellable elastomer 622 is in the closed position. The size and materials of the swellable elastomer 622 may be selected such that the closing of the swellable elastomer 622 occurs after a predetermined amount of time. In one or more exemplary embodiments, the swellable elastomer 622 may be located in any area of the valve 575 such that the swelling of the swellable elastomer forces the valve 575 into a closed position. In one or more exemplary embodiments, the valve 575 includes the LOD 605. That is, the valve 575 may include shear pins or shear screws that lock the valve 575 in a closed position upon shearing of the shear pins or shear screws. However, the valve 575 may be secured in a closed position in a variety of ways, such as for example, a lock ring grabbing a rod to prevent the rod from returning to open the valve 575.

Figure 14:
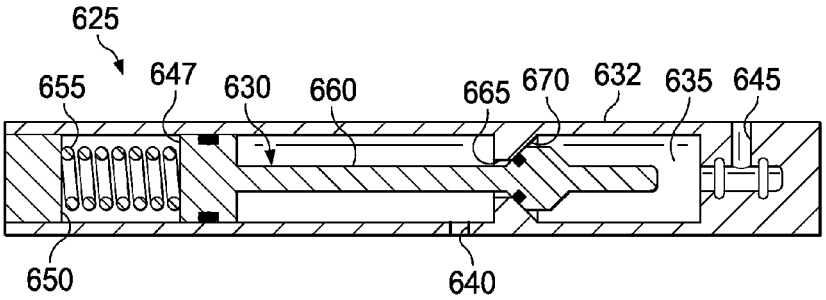
FIG. 14 is a section view of a seventh embodiment of the pressure maintenance device of FIG. 1, according to an exemplary embodiment of the present disclosure.
Figure 15:
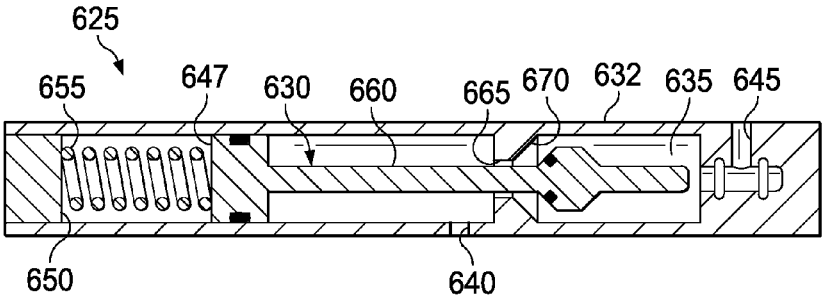
FIG. 15 is another section view of the seventh embodiment of the pressure maintenance device of FIG. 1, according to an exemplary embodiment of the present disclosure.
Figure 16:
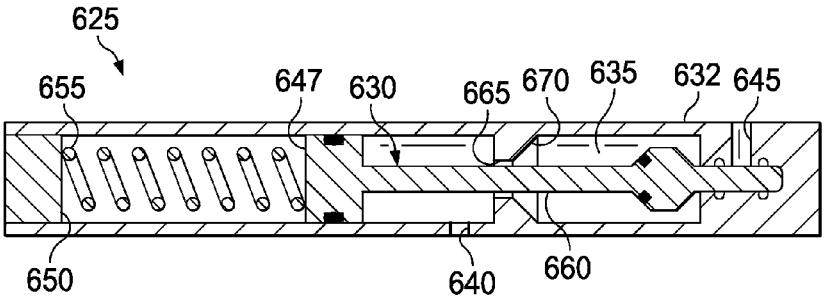
FIG. 16 is yet another section view of the seventh embodiment of the pressure maintenance device of FIG. 1, according to an exemplary embodiment of the present disclosure.

In one or more exemplary embodiments, and as illustrated in FIGS. 14, 15, and 16, another embodiment of the PMD 140 is a MPMD 625 that includes a valve 630 disposed within a tubing 632. In one or more exemplary embodiments, the valve 630 that may be three-position spool valve that opens or closes based on a pressure differential. In one or more exemplary embodiments, the MPMD 625 includes a flow path 635 that extends from an opening 640 within the tubing 632 and that is exposed to the external pressure to an opening 645 within the tubing 632 that is exposed to the internal pressure. In an exemplary embodiment, the valve 630 opens and closes based on pressure differential between a pressure exerted on a piston 647 of the valve 630 and either the external pressure or the internal pressure. In an exemplary embodiment, the valve 630 measures the external pressure. In an exemplary embodiment, a surface of the piston 647 at least partially defines a gas filled chamber 650. In an exemplary embodiment, the gas filled chamber 650 is filed with nitrogen gas to a pressure that is a fraction of the well hydrostatic pressure. In one or more exemplary embodiments, a spring 655 is disposed within the gas filled chamber 650 and configured to push against the piston 647. In one or more exemplary embodiments and when the valve 630 is in the first position as illustrated in FIG. 16 the gas charge is greater than well hydrostatics and the spring 655 is in the fully stroked position and a rod 660 of the valve 630 blocks the flow path 635 near the opening 645 to close the valve 630. In one or more exemplary embodiments and when the valve 630 is in the second position, or the open position, as illustrated in FIG. 15, the gas charge and spring 655 is partially compressed and is balanced with the well hydrostatics such that the rod 660 does not block the flow path 635 and fluid may flow from the opening 640 to the opening 645. In one or more exemplary embodiments, the external pressure exerted on the piston 647 is sufficient to push the piston 647 and compress the spring 655, thereby opening the valve 630. In one or more exemplary embodiments, and as illustrated in FIG. 14, the gas charge and spring 655 is compressed by the internal pressure through 640 such that an opening 665 in a seat 670 is blocked by the rod 660 such that the fluid path 635 is blocked and the valve 630 is closed. In an exemplary embodiment, the valve 630 is in the position illustrated in FIG. 16 when located at the surface of the well. In one or more exemplary embodiments, the valve 630 being closed while in the first position allows for the lower completion system 87 to be tested at the surface of the well. In one or more exemplary embodiments, the spring 655, the gas charge inside of chamber 650, and/or the size of the rod 660 are selected to create a predetermined pressure range in which the valve 630 is in the open position. In one or more exemplary embodiments, the valve 630 may be any type of valve, such as a shuttle valve. In one or more exemplary embodiments, the use of the MPMD 625 allows for the valve 630 to open and close based on a pressure differential between at least in part, an atmospheric pressure or predetermined pressure and the external pressure or the internal pressure. In an exemplary embodiment, the MPMD includes the LOD 605.

The method of operation of the MPMD 555 or the MPMD 625 may include lowering the lower completion system 87, which includes the MPMD 555 or the MPMD 625, downhole, isolating a production zone of the lower completion system 87, maintaining the predetermined pressure range in the production zone of the lower completion system 87 using the MPMD 555 or the MPMD 625, gravel packing the production, and permanently closing the flow path 635 using the LOD 605. At the surface of the well, the pressure exerted on the piston 647 is sufficiently higher than the external pressure to close the valve 630. As the MPMD 555 or the MPMD 625 is lowered downhole, the external and internal pressure increases such that the valve 630 opens and fluid flows from the internal region to the external region. When a packer is set, the internal pressure increase greatly, thereby closing the valve 630. Once the internal pressure is reduced, the valve 630 opens to pressurize the external region. Gravel packing operations may then begin. After a period of time or once an internal pressure has been reached, the LOD 605 is activated and the flow path 635 is permanently blocked. In one or more embodiments, the MPMD 555 or the MPMD 625 may be used to maintain a certain desired excess pressure above the reservoir pressure in the wellbore annulus 150 to prevent or at least reduce uncontrolled fluid production into any part of the production zone. In one or more exemplary embodiments, the MPMD 555 or the MPMD 625 encourages maintaining the wellbore annulus 150 in a clean state to prevent premature blocking of the proppant during a frac-pack or gravel pack operation. In one or more exemplary embodiments, the MPMD 555 or the MPMD 625 prevents or at least reduces the likelihood of the wellbore 80 collapsing in the case of an unconsolidated formation. In an exemplary embodiment, the MPMD 555 or the MPMD 625 may be used to maintain the predetermined pressure range during a variety of operations, such as for example, during the setting of the isolation packer, zone pressure testing, frac packing lower zones, and reversing out lower zones following the frac pack. In an exemplary embodiment, the MPMD 555 or the MPMD 625 will prevent or at least reduce the likelihood of cross flow between production zones and cross flow within one production zone. In one or more exemplary embodiments, the MPMD 555 or the MPMD 625 may also prevent or at least reduce the likelihood of over-pressurizing the formation 20.

In one or more exemplary embodiments, the PMD 140 forms a portion of a wall of the tubing string 87 and each of the components are of the cartridge type configuration.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments. For example, and in one or more exemplary embodiments, the LOD 605 may be present in the DPPMD 173, the SPPMD 392, and the EPMD 450. Additionally, and in one or more exemplary embodiments, the controller 495 may be present in the DPPMD 173, the SPPMD 392, the MPMD 555, and the MPMD 625.

Figure 17:
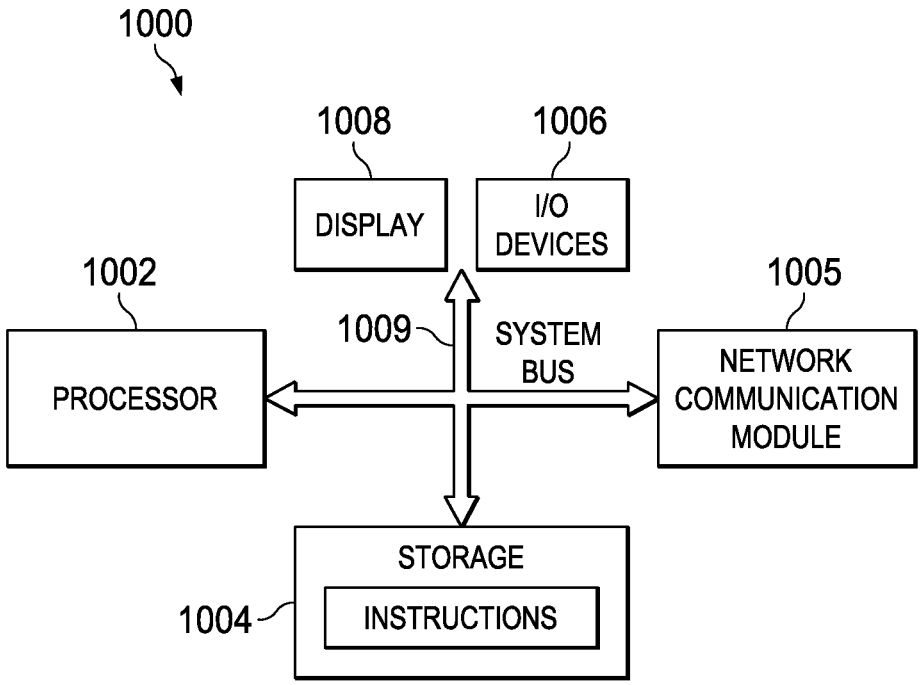
FIG. 17 is a block diagram of a computer system adapted for implementing a pressure maintenance device, according to an exemplary embodiment of the present disclosure.

FIG. 17 is a block diagram of an exemplary computer system 1000 adapted for implementing the features and functions of the disclosed embodiments. In certain embodiments, the computer system 100 may be integrated locally with the PMD 140 while in other embodiments the computer system 100 may be external from the PMD 140. In one embodiment, the computer system 1000 includes at least one processor 1002, a non-transitory, computer-readable storage 1004, an optional network communication module 1005, optional I/O devices 1006, and an optional display 1008, and all interconnected via a system bus 1009. To the extent a network communications module 1005 is included, the network communication module 1005 is operable to communicatively couple the computer system 1000 to other devices over a network. In one embodiment, the network communication module 1005 is a network interface card (NIC) and communicates using the Ethernet protocol. In other embodiments, the network communication module 1005 may be another type of communication interface such as a fiber optic interface and may communicate using a number of different communication protocols. It is recognized that the computer system 1000 may be connected to one or more public (e.g. the Internet) and/or private networks (not shown) via the network communication module 1005. Software instructions 1010 executable by the processor 1002 for implementing the PMD 140 in accordance with the embodiments described herein, may be stored in storage 1004. It will also be recognized that the software instructions 1010 may be loaded into storage 1004 from a CD-ROM or other appropriate storage media.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a completion assembly has been described. Embodiments of the assembly may generally include an elongated base pipe having an external surface at least partially defining an external region and an internal surface at least partially defining an internal region; and a pressure maintenance device disposed in the base pipe and including a first flow path that extends between an opening in the external surface and an opening in the internal surface; a first valve that controls the flow of a first fluid from the internal region to the external region through the first flow path; a first pressure differential sensor that controls the actuation of the first valve and is in fluid communication with the external region; and a pressurized fluid source in fluid communication with the first pressure differential sensor; wherein a first pressure differential threshold associated with the first pressure differential sensor is the difference between a pressure within the external region and the pressurized fluid source. For any of the foregoing embodiments, the assembly may include any one of the following elements, alone or in combination with each other:

The pressure maintenance device includes a second flow path that extends between the pressurized fluid source and the external region; a third valve that controls the flow of a second fluid through the second flow path and towards the pressurized fluid source; a third pressure differential sensor that controls the actuation of the third valve; wherein the third pressure differential sensor is in fluid communication with the external region and the first flow path; and wherein a third pressure differential threshold associated with the third pressure differential sensor is the difference between a pressure within the first flow path and the pressure within the external region.

The pressurized fluid source is an accumulator.

The pressure maintenance device further including at least one of: a pressure relief valve that is in fluid communication with the pressurized fluid source and with the external region; and a rupture disk that is in fluid communication with the pressurized fluid source and with the external region.

The pressure maintenance device further includes a fourth valve that controls the flow of the fluid through the first flow path, the fourth valve being a flow control valve; and a fourth pressure differential sensor that controls the actuation of the fourth valve.

The fourth valve is located along the first flow path between the opening in the external surface and the first valve.

The first valve is located along the first flow path between the fourth valve and the second valve.

The second valve is located along the first flow path between the first valve and the opening in the internal surface.

Thus, a method for maintaining an isolated portion of an external region of a completion string within a predetermined pressure range has been described. Embodiments of the method may generally include positioning a completion string that has an internal surface that at least partially defines an internal region and an external surface that at least partially defines an external region within a wellbore; pressurizing a pressurized fluid source located within a pressure maintenance device that is located within a wall of the completion string to a reference pressure that is associated with a wellbore hydrostatic pressure within the external region; isolating a portion of the external region from the wellbore hydrostatic pressure to form the isolated portion of the external region; and allowing a first fluid within the internal region to flow through a first flow path within the pressure maintenance device to the isolated portion of the external region when a pressure differential between the external region and the reference pressure is less than a first pressure differential threshold that is associated with the predetermined pressure range. For any of the foregoing embodiments, the method may include any one of the following elements, alone or in combination with each other:

Preventing the first fluid within the internal region from flowing through the first flow path when a pressure differential between the internal region and the external region exceeds a second pressure differential threshold.

The pressurized fluid source includes an accumulator in fluid communication with the external region.

Pressurizing the pressurized fluid source to the reference pressure that is associated with the wellbore hydrostatic pressure within the external region includes allowing a second fluid to pressurize the accumulator to the reference pressure when the pressure differential between a pressure within the first flow path and the external region is less than a fourth pressure differential threshold; and preventing the second fluid from pressurizing the accumulator after the pressure differential between the internal region and the external region exceeds the fourth pressure differential threshold.

The pressure maintenance device includes a relief valve that is in fluid communication with the pressurized fluid source and with the external region.

Depressurizing the pressurized fluid source when a first relief pressure differential threshold associated with the relief valve is exceeded.

The pressure maintenance device includes a rupture disk that is in fluid communication with the pressurized fluid source and with the external region.

Depressurizing the pressurized fluid source when a second relief pressure differential threshold associated with the rupture disk is met or exceeded.

Allowing the first fluid within the internal region to flow through the first flow path when a pressure differential between the external region and the reference pressure is less than a first pressure differential threshold that is associated with the predetermined pressure range includes opening a first valve that controls the flow of the first fluid through the first flow path.

Preventing the first fluid within the internal region from flowing through the first flow path when a pressure differential between the internal region and the external region exceeds a second pressure differential threshold includes closing a second valve that controls the flow of the first fluid through the first flow path.

Allowing the first fluid to flow through the first flow path when a third pressure differential across a third valve exceeds a third pressure differential threshold associated with the third valve.

Isolating a portion of the external region to form the isolated portion of the external region includes setting a packer that is disposed on the completion string.

Thus, a method of providing pressure maintenance is described. Embodiments of the method may generally include positioning a completion string within a wellbore, the completion string having an internal surface that at least partially defines an internal region and an external surface that at least partially defines an external region; isolating a portion of the external region from a wellbore hydrostatic pressure; fluidically connecting the internal region to the isolated portion of the external region via a first flow path; providing a first valve that controls the flow of a first fluid through the first flow path, the first valve including a first pressure differential sensor; opening the first valve when the first pressure differential sensor measures a pressure differential between an external pressure within the isolated portion of the external region and a reference pressure that is less than a first pressure threshold; and closing the first valve when the pressure differential between the external pressure and the reference pressure is greater than or equal to the first pressure threshold. For any of the foregoing embodiments, the method may include any one of the following, alone or in combination with each other:

Providing a second valve that controls the flow of the first fluid through the first flow path, the second valve including a second pressure differential sensor.

Opening the second valve when the second pressure differential sensor measures a pressure differential between an internal pressure associated with the internal region and the external pressure that is less than a second pressure threshold.

Closing the second valve when the pressure differential between the internal pressure and the external pressure within the isolated portion of the external region is greater than or equal to the second pressure threshold.

Providing a flow control valve that controls the flow of the first fluid through the first flow path.

Pressurizing an accumulator that is located within the completion string and that is in fluid communication with the external region to the external pressure.

Pressurizing the accumulator includes flowing a second fluid from the external region in a direction towards the accumulator.

Closing a fifth valve that controls the flow of the second fluid when a fifth pressure differential sensor measures a pressure differential between the first flow path and the external pressure that is greater than a fifth pressure threshold associated with the fifth pressure differential sensor.

The first pressure differential sensor includes a spring.

The reference pressure is the wellbore hydrostatic pressure.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A completion assembly comprising:

an elongated base pipe having an external surface at least partially defining an external region and an internal surface at least partially defining an internal region;

a pressure maintenance device disposed in the base pipe and comprising:

a first flow path that extends between an opening in the external surface and an opening in the internal surface;

a first valve that controls the flow of a first fluid from the internal region to the external region through the first flow path;

a first pressure differential sensor that controls the actuation of the first valve and is in fluid communication with the external region;

a pressurized fluid source in fluid communication with the first pressure differential sensor;

a second valve that controls the flow of the first fluid from the internal region to the external region through the first flow path; and a second pressure differential sensor that controls the actuation of the second valve;

wherein a first pressure differential threshold associated with the first pressure differential sensor is the difference between a pressure within the external region and the pressurized fluid source;

wherein the second pressure differential sensor is in fluid communication with the external region and the internal region; and wherein a second pressure differential threshold associated with the second pressure differential sensor is the difference between a pressure within the internal region and the pressure within the external region.

2. The completion assembly of claim 1, wherein the pressure maintenance device further comprises:

a second flow path that extends between the pressurized fluid source and the external region;

a third valve that controls the flow of a second fluid through the second flow path and towards the pressurized fluid source;

a third pressure differential sensor that controls the actuation of the third valve;

wherein the third pressure differential sensor is in fluid communication with the external region and the first flow path; and wherein a third pressure differential threshold associated with the third pressure differential sensor is the difference between a pressure within the first flow path and the pressure within the external region.

3. The completion assembly of claim 2, wherein the pressurized fluid source is an accumulator.

4. The completion assembly of claim 3, wherein the pressure maintenance device further comprises at least one of:

a pressure relief valve that is in fluid communication with the pressurized fluid source and with the external region; and a rupture disk that is in fluid communication with the pressurized fluid source and with the external region.

5. The completion assembly of claim 2, wherein the pressure maintenance device further comprises:

a fourth valve that controls the flow of the fluid through the first flow path, the fourth valve being a flow control valve; and a fourth pressure differential sensor that controls the actuation of the fourth valve.

6. The completion assembly of claim 5, wherein the fourth valve is located along the first flow path between the opening in the external surface and the first valve;

wherein the first valve is located along the first flow path between the fourth valve and the second valve; and wherein the second valve is located along the first flow path between the first valve and the opening in the internal surface.

7. A method of maintaining an isolated portion of an external region of a completion string within a predetermined pressure range, the method comprising:

positioning a completion string that has an internal surface that at least partially defines an internal region and the external surface that at least partially defines an external region within a wellbore;

pressurizing a pressurized fluid source located within a pressure maintenance device that is located within a wall of the completion string to a reference pressure that is associated with a wellbore hydrostatic pressure within the external region;

isolating a portion of the external region from the wellbore hydrostatic pressure to form the isolated portion of the external region; and allowing a first fluid within the internal region to flow through a first flow path within the pressure maintenance device to the isolated portion of the external region when a pressure differential between the external region and the reference pressure is less than a first pressure differential threshold that is associated with the predetermined pressure range.

8. The method of claim 7, further comprising preventing the first fluid within the internal region from flowing through the first flow path when a pressure differential between the internal region and the external region exceeds a second pressure differential threshold.

9. The method of claim 7, wherein the pressurized fluid source comprises an accumulator in fluid communication with the external region; and wherein pressurizing the pressurized fluid source to the reference pressure that is associated with the wellbore hydrostatic pressure within the external region comprises:

allowing a second fluid to pressurize the accumulator to the reference pressure when the pressure differential between a pressure within the first flow path and the external region is less than a fourth pressure differential threshold; and preventing the second fluid from pressurizing the accumulator after the pressure differential between the internal region and the external region exceeds the fourth pressure differential threshold.

10. The method of claim 7, wherein the pressure maintenance device comprises a relief valve that is in fluid communication with the pressurized fluid source and with the external region; and wherein the method further comprises depressurizing the pressurized fluid source when a first relief pressure differential threshold associated with the relief valve is exceeded.

11. The method of claim 7, wherein the pressure maintenance device comprises a rupture disk that is in fluid communication with the pressurized fluid source and with the external region; and wherein the method further comprises depressurizing the pressurized fluid source when a second relief pressure differential threshold associated with the rupture disk is met or exceeded.

12. The method of claim 7, wherein allowing the first fluid within the internal region to flow through the first flow path when a pressure differential between the external region and the reference pressure is less than a first pressure differential threshold that is associated with the predetermined pressure range comprises opening a first valve that controls the flow of the first fluid through the first flow path.

13. The method of claim 8, wherein preventing the first fluid within the internal region from flowing through the first flow path when a pressure differential between the internal region and the external region exceeds a second pressure differential threshold comprises closing a second valve that controls the flow of the first fluid through the first flow path.

14. The method of claim 13, further comprising allowing the first fluid to flow through the first flow path when a third pressure differential across a third valve exceeds a third pressure differential threshold associated with the third valve.

15. The method of claim 8, wherein isolating a portion of the external region to form the isolated portion of the external region comprises setting a packer that is disposed on the completion string.

16. A method of providing pressure maintenance comprising:

positioning a completion string within a wellbore, the completion string having an internal surface that at least partially defines an internal region and an external surface that at least partially defines an external region;

isolating a portion of the external region from a wellbore hydrostatic pressure;

fluidically connecting the internal region to the isolated portion of the external region via a first flow path;

providing a first valve that controls the flow of a first fluid through the first flow path, the first valve comprising a first pressure differential sensor;

opening the first valve when the first pressure differential sensor measures a pressure differential between an external pressure within the isolated portion of the external region and a reference pressure that is less than a first pressure threshold;

closing the first valve when the pressure differential between the external pressure and the reference pressure is greater than or equal to the first pressure threshold;

providing a second valve that controls the flow of the first fluid through the first flow path, the second valve comprising a second pressure differential sensor;

opening the second valve when the second pressure differential sensor measures a pressure differential between an internal pressure associated with the internal region and the external pressure that is less than a second pressure threshold; and closing the second valve when the pressure differential between the internal pressure and the external pressure within the isolated portion of the external region is greater than or equal to the second pressure threshold.

17. The method of claim 16, further comprising providing a flow control valve that controls the flow of the first fluid through the first flow path.

18. The method of claim 16, further comprising:

pressurizing an accumulator that is located within the completion string and that is in fluid communication with the external region to the external pressure, wherein pressurizing the accumulator comprises flowing a second fluid from the external region in a direction towards the accumulator; and closing a fifth valve that controls the flow of the second fluid when a fifth pressure differential sensor measures a pressure differential between the first flow path and the external pressure that is greater than a fifth pressure threshold associated with the fifth pressure differential sensor.

19. The method of claim 16, wherein the first pressure differential sensor comprises a spring.

20. The method of claim 16, wherein the reference pressure is the wellbore hydrostatic pressure.

* * * * *